US011168461B2

(12) United States Patent
Boyd et al.

(10) Patent No.: US 11,168,461 B2
(45) **Date of Patent: *Nov. 9, 2021**

(54) FRONT LOADER AND WORK MACHINE

(71) Applicant: KUBOTA CORPORATION, Osaka (JP)

(72) Inventors: Robert Stewart Boyd, Jefferson, GA (US); Erik Baker, Jefferson, GA (US)

(73) Assignee: KUBOTA CORPORATION, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/078,635

(22) Filed: Oct. 23, 2020

(65) Prior Publication Data

US 2021/0040709 A1 Feb. 11, 2021

Related U.S. Application Data

(63) Continuation of application No. 16/353,435, filed on Mar. 14, 2019, now Pat. No. 10,851,518.

(51) Int. Cl.

| | |
|---|---|
| ***E02F 9/08*** | (2006.01) |
| ***E02F 3/34*** | (2006.01) |
| ***E02F 3/38*** | (2006.01) |

(52) U.S. Cl.

CPC ..... *E02F 9/0808* (2013.01); *E02F 3/3405* (2013.01); *E02F 3/38* (2013.01)

(58) Field of Classification Search

None

See application file for complete search history.

(56) References Cited

U.S. PATENT DOCUMENTS

| | | | |
|---|---|---|---|
| 2005/0111952 | A1 | 5/2005 | Westendorf et al. |
| 2015/0093227 | A1 | 4/2015 | Faivre |
| 2018/0327998 | A1 | 11/2018 | Torii et al. |

FOREIGN PATENT DOCUMENTS

| | | | |
|---|---|---|---|
| EP | 3 211 142 | A2 | 8/2017 |
| GB | 2 044 724 | A | 10/1980 |
| JP | 2005016023 | A | 1/2005 |
| JP | 2017-106180 | | 6/2017 |

OTHER PUBLICATIONS

Extended European Search Report dated May 28, 2020 in European Patent Application No. 20159940.4.

*Primary Examiner* — Ronald P Jarrett

(74) *Attorney, Agent, or Firm* — Greenblum & Bernstein, P.L.C.

(57) ABSTRACT

A front loader includes a boom, a main frame attached to a vehicle body, a sub frame supporting the boom and being detachably attached to the main frame. The front loader includes a receiving tool provided on the main frame a cylindrical shaft provided on the sub frame and configured to be engaged with the receiving tool when attaching the sub frame to the main frame, a protruding portion protruding from the main frame and configured to guide the cylindrical shaft to be engaged with the receiving tool, and a coupling plate provided on the sub frame, the coupling plate having an opening through which the protruding portion is inserted when the cylindrical shaft is engaged with the receiving tool. The protruding portion protrudes forward from the main frame in a front-rear direction of the vehicle body.

14 Claims, 19 Drawing Sheets

FRONT LOADER AND WORK MACHINE

CROSS REFERENCE TO RELATED APPLICATIONS

This is a continuation application of U.S. patent application Ser. No. 16/353,435, filed Mar. 14, 2019. The entire disclosure of the above-identified application, including the specification, drawings, and claims thereof, is herein incorporated by reference in its entirety.

BACKGROUND OF THE INVENTION

Field of the Invention

The present invention relates to a front loader and to a working machine having the front loader.

Description of Related Art

A front loader disclosed in Japanese Patent Application Publication No. 2017-106180 (Patent Document 1) is previously known.

The front loader disclosed in Patent Document 1 includes an attachment mechanism that is detachably attached to a vehicle body of a tractor. The attachment mechanism includes engaged members provided on the left side and right side of the vehicle body and engaging members provided on the left side and right side of the front loader. The engaging members are engaged with the engaged members, and thereby the front loader is attached to the vehicle body.

SUMMARY OF THE INVENTION

Problems to be Solved by the Invention

However, when the vehicle body is inclined with respect to the front loader (for example, when the front loader keeps a horizontal posture but the left side and right side of the vehicle body have heights different from each other, or the vehicle body keeps a horizontal posture but the left side and right side of the front loader have heights different from each other), it will be difficult to smoothly engage the engaging members with the engaged members on both of the left side and the right side. Thus, there has been a problem that it takes much time for the attaching of the front loader.

In view of the above-mentioned problems, the present invention intends to provide a front loader configured to be easily attached to a vehicle body even when the vehicle body is inclined with respect to the front loader, and provide a working machine having the front loader.

Means of Solving the Problems

To solve the problem mentioned above, the present invention employs the following technical means.

A front loader according to an aspect of the present invention includes a boom, a main frame attached to a vehicle body, a sub frame supporting the boom and being detachably attached to the main frame. The front loader includes a receiving tool provided on the main frame a cylindrical shaft provided on the sub frame and configured to be engaged with the receiving tool when attaching the sub frame to the main frame, a protruding portion protruding from the main frame and configured to guide the cylindrical shaft to be engaged with the receiving tool, and a coupling plate provided on the sub frame, the coupling plate having an opening through which the protruding portion is inserted when the cylindrical shaft is engaged with the receiving tool. The protruding portion protrudes forward from the main frame in a front-rear direction of the vehicle body.

A working machine according to an aspect of the present invention includes the front loader according to the aspect of the present invention, and includes the vehicle body supporting the front loader.

DESCRIPTION OF THE EMBODIMENTS

Hereinafter, an embodiment of the present invention will be described with reference to the drawings.

<Working Machine>

Figure 1:
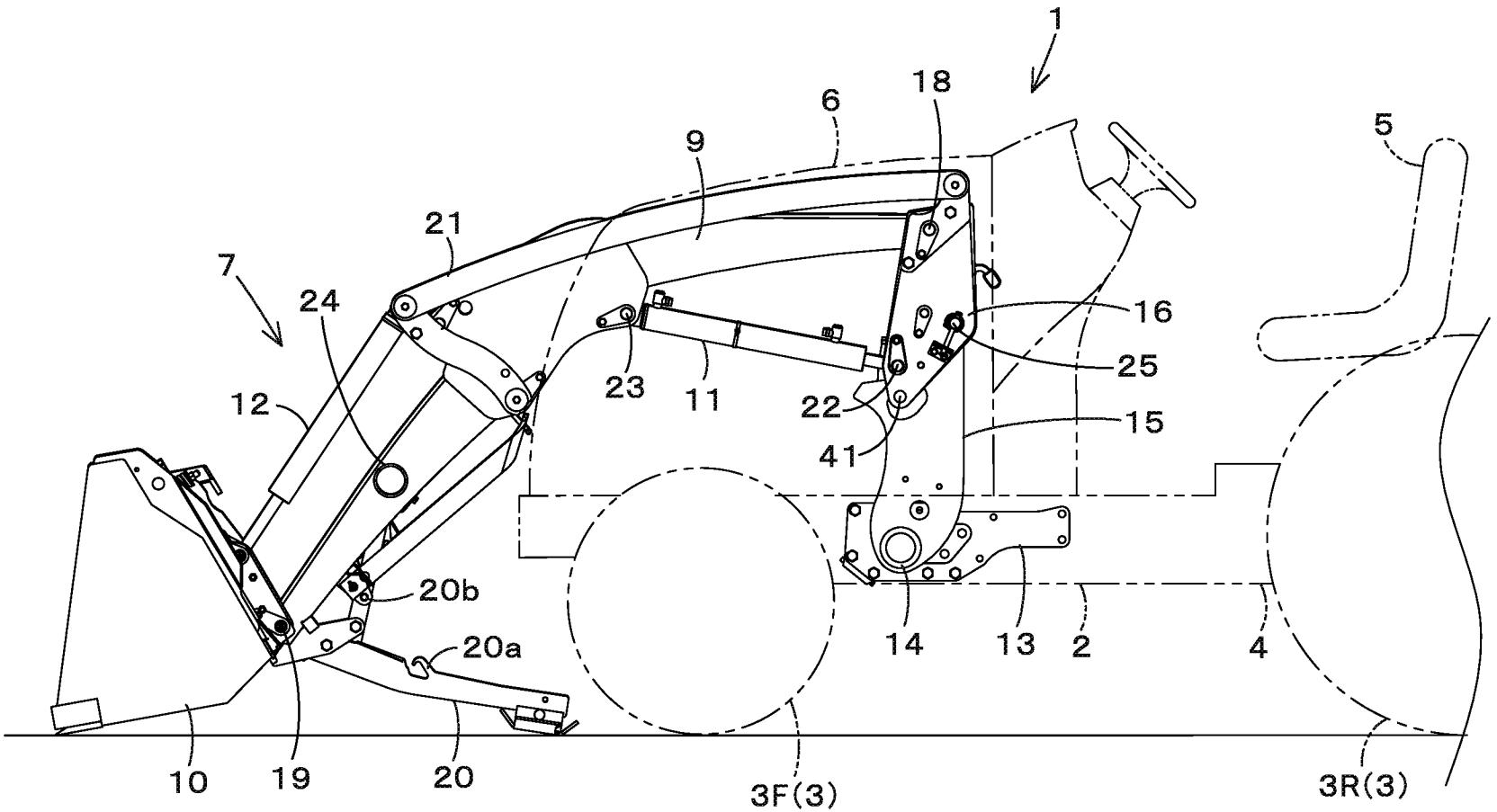
FIG. 1 is a side view of a working machine according to an embodiment of the present invention.

FIG. 1 is a side view showing an embodiment of a working machine 1. In the present embodiment, the working machine 1 is a tractor. However, the working machine 1 is not limited to the tractor, and may be another type of the working machine (a working vehicle).

In the explanations described below, a front side of the operator seated on the operator seat 5 of the tractor (working machine) 1 (a left side in FIG. 1) will be the front, and a rear side of the operator (the right side in FIG. 1) will be referred to as the rear. A left side of the operator (the front surface side of FIG. 1) will be referred to as the left, and a right side of the operator (the back surface side of FIG. 1) will be described as the right. In addition, a horizontal direction (a depth direction in a sheet of FIG. 1) which is a direction orthogonal to a front-rear direction (a machine longitudinal direction) of the working machine 1 will be referred to as a machine width direction in the explanation. Moreover, a direction corresponding to the machine width direction and separating away from a center of the vehicle body will be referred to as a machine outward direction, and a direction corresponding to the machine width direction and approaching the center of the vehicle body will be referred to as a machine inward direction.

The tractor 1 includes a vehicle body 2 and a traveling device 3.

An operator seat 5 is arranged on an upper portion of the vehicle body 2. A bonnet 6 is arranged on a front portion of the vehicle body 2. An engine or the like is housed inside the bonnet 6. A clutch housing, a transmission case 4 and the like are arranged on a rear portion of the vehicle body 2. The traveling device 3 has a front wheel 3F arranged on the front portion of the vehicle body 2 and has a rear wheel 3R arranged on the rear portion of the vehicle body 2.

A front loader 7 is attached to the vehicle body 2. The front loader 7 is supported by the front portion of the vehicle body 2. The front loader 7 will be described below.

<Front Loader>

Figure 2:
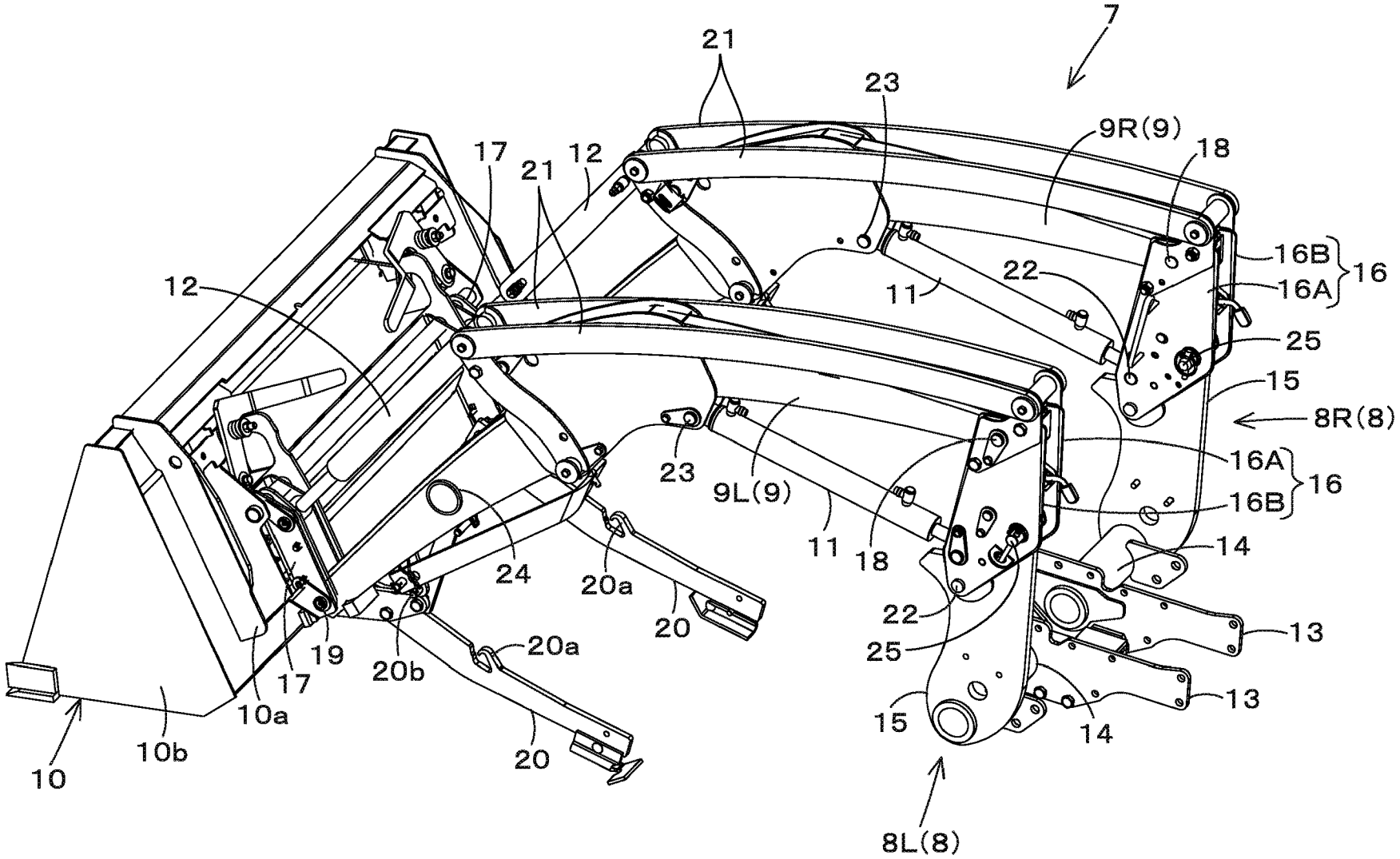
FIG. 2 is a perspective view of a front loader according to the embodiment.

As shown in FIG. 2 and the like, the front loader 7 includes an attachment frame 8, a boom 9, a bucket 10, a boom cylinder 11, and a bucket cylinder 12.

The attachment frame 8 includes a left frame 8L and a right frame 8R. Each of the left frame 8L and the right frame 8R has an attachment plate 13, a support body 14, a main frame 15, and a sub frame 16.

The attachment plate 13 is configured to be attached to the left side of the vehicle body 2, and another attachment plate 13 is configured to be attached to the right side of the vehicle body 2. The attachment plate 13 of the left frame 8L is configured to be attached to the left side of the vehicle body 2. The attachment plate 13 of the right frame 8R is configured to be attached to the right side of the vehicle body 2. The support body 14 protrudes outward from the attachment plate 13 arranged on the left and the attachment plate 13 arranged on the right, respectively.

Figure 3:
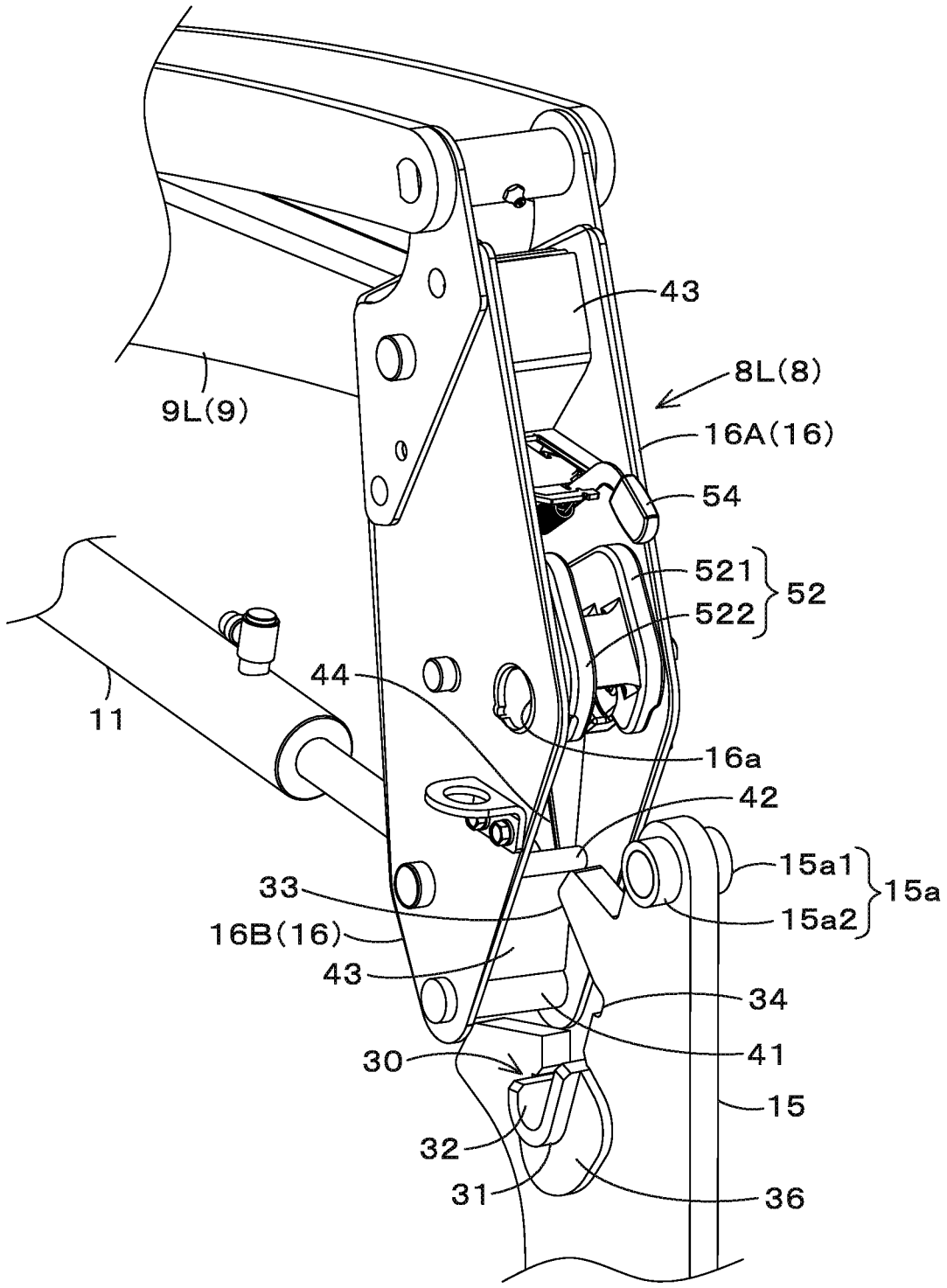
FIG. 3 is a rear perspective view illustrating a main frame and a sub frame according to the embodiment.

The main frame 15 has a flat plate shape, and is provided extending upward in the machine outward direction from the end portion of the support body 14 arranged on the left and the end portion of the support body 14 arranged on the right. As shown in FIG. 3, the main frame 15 has a boss 15*a* having a cylindrically protruding shape. The boss 15*a* is arranged on an upper portion of the main frame 15. The boss 15*a* includes an inner boss 15*al* protruding toward the inside of the vehicle body and includes an outer boss 15*a*2 protruding toward the outside of the vehicle body. As shown in FIG. 1, the attachment plate 13 is attached to the vehicle body 2, and thereby the main frame 15 is attached to the vehicle body 2 by the support body 14.

The sub frame 16 is attached to the main frame 15. The sub frame 16 can be attached to and detached from the main frame 15. The sub frame 16 extends upward from the main frame 15 under a state where the sub frame 16 is attached to the main frame 15 (see FIG. 1). As shown in FIG. 2 and FIG. 3, the sub frame 16 includes an inner sub frame 16A and an outer sub frame 16B. The inner sub frame 16A and the outer sub frame 16B are arranged to be opposed to each other. The inner sub frame 16A is arranged on the machine inward side. The outer sub frame 16B is arranged on the machine outward side.

Figure 8:
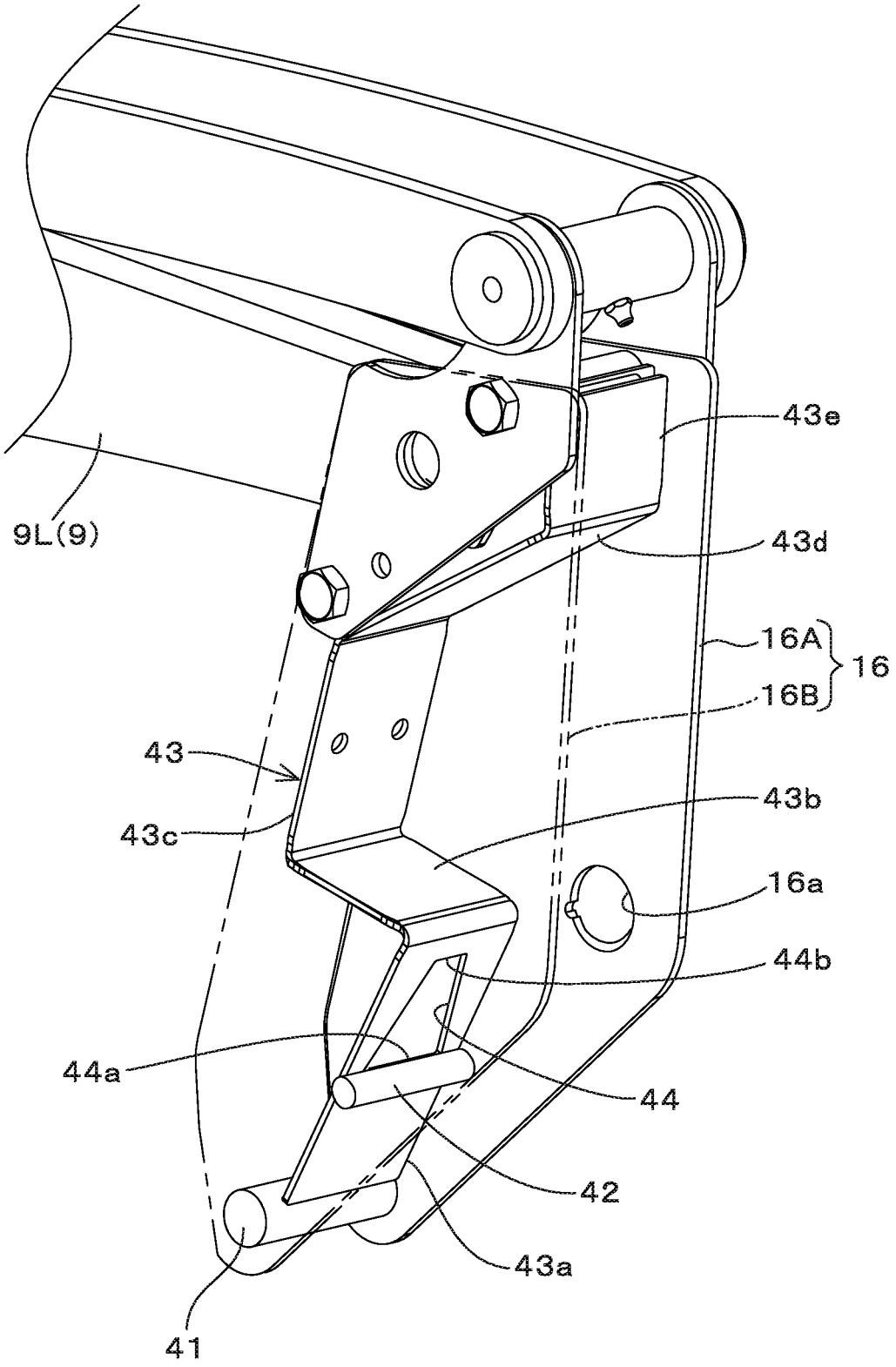
FIG. 8 is a rear perspective view illustrating a coupling plate arranged on the sub frame, a guide pin, a second engaging portion, and the like according to the embodiment.

As shown to FIG. 3 and FIG. 8, the through hole 16*a* is formed in the sub frame 16 (the inner sub frame 16A and the outer sub frame 16B). The through hole 16*a* is overlapped with the inner hole of the boss 15*a* of the main frame 15 under a state where the front loader 7 is attached to the vehicle body 2. A cylindrical boss may be provided around the through hole 16*a*.

As shown in FIG. 2, a pivot shaft 18 extending in the machine width direction is arranged on the upper portion of the sub frame 16. The pivot shaft 18 extends from the inner sub frame 16A to the outer sub frame 16B. The sub frame 16 supports the boom 9 with the pivot shaft 18.

As shown in FIG. 2, the boom 9 includes a left boom 9L and a right boom 9R. The left boom 9L is supported by the left frame 8L. The right boom 9R is supported by the right frame 8R. The middle portion of the left boom 9L and the middle portion of the right boom 9R are coupled to each other by a coupling body 24. In this manner, the left boom 9L and the right boom 9R are integrally operated. The base end side of the boom 9 (the left boom 9L and the right boom 9R) is supported and configured to be swung about the pivot shaft 18 arranged on the attachment frame 8 (the sub frame 16). A pivot shaft 19 extending in the machine width direction is arranged on the tip end side of the boom 9.

The boom 9 is provided with a stand 20. The stand 20 is arranged on the left boom 9L, and another stand 20 is arranged on the right boom 9R, respectively. The stand 20 arranged on the left extends in the front-rear direction below the left boom 9L. The stand 20 arranged on the right extends in the front-rear direction below the right boom 9R.

The stand 20 is configured to be turned upward or downward around a pivot shaft arranged at the front portion. FIG. 1 and FIG. 2 show a state in which the stand 20 is turned downward (a state of being moved downward). The stand 20 is provided with an engaging portion 20*a*. The engaging portion 20*a* can be engaged with the engaged portion 20*b* at a position where the stand 20 is turned upward, the engaged portion 20*b* being provided on the boom 9 side. Although not shown in the drawings, the engaged portion 20*b* is coupled to an operation tool by a linkage mechanism, the operation tool being arranged behind the sub frame 16. The operation tool can be operated in a state where the operator is seated on the operator seat 5. By operating the operation tool, the engagement between the engaging portion 20*a* and the engaged portion 20*b* can be released. The stand 20 can be grounded by being turned downward after the engagement of the engaging portion 20*a* is released, and thereby the front loader 7 detached from the vehicle body 2 can be supported on the ground.

As shown in FIG. 1 and FIG. 2, the boom cylinder 11 couples the sub frame 16 and the boom 9 with each other. As shown in FIG. 2, one end portion (a base end portion) of the boom cylinder 11 is pivotally supported with a lateral shaft 22 by the sub frame 16. The other end portion (a tip end portion) of the boom cylinder 11 is pivotally supported with a lateral shaft 23 at a middle portion of the boom 9 in the front-rear direction (the longitudinal direction). The boom 9 is swung upward about the pivot shaft 18 by the stretching of the boom cylinder 11, and is swung downward about the pivot shaft 18 by shortening of the boom cylinder 11. The boom cylinder 11 is constituted of a hydraulic cylinder.

As shown in FIG. 2, the bucket 10 includes a bucket bracket 10*a* and a bucket body 10*b*. The bucket bracket 10*a* is supported swingably around a pivot shaft 19. The bucket body 10*b* is a portion that shovels (contains) soil and the like, and is attached to the front portion of the bucket bracket 10*a*. The bucket bracket 10*a* and the bucket body 10*b* integrally turn about the pivot shaft 19.

As shown in FIG. 2, a cylinder bracket 17 is arranged on a back surface of the bucket 10. One end portion (a tip end portion) of the bucket cylinder 12 is attached to the cylinder bracket 17. The other end portion (a base end portion) of the bucket cylinder 12 is attached to the posture holding mechanism 21 disposed on the boom 9. The posture holding mechanism 21 is a mechanism configured to preliminarily set a ground posture such as a shoveling posture of the bucket 10. The posture holding mechanism 21 is attachable to and detachable from the boom 9. When the posture holding mechanism 21 is detached from the boom 9, the other end portion (the base end portion) of the bucket cylinder 12 is attached to a middle portion of the boom 9 in the front-rear direction (in the longitudinal direction). The bucket 10 moves about the pivot shaft 19 to perform a shoveling operation due to the stretching of the bucket cylinder 12, and moves about the pivot shaft 19 to perform a dumping operation due to the shortening of the bucket cylinder 12. The bucket cylinder 12 is constituted of a hydraulic cylinder.

<Attachment Detachment Structure of Front Loader>

As shown in FIG. 1, the main frame 15 is attached to the vehicle body 2 with the support body 14 and the attachment frame 13. The sub frame 16 is configured to be attached to and detached from the main frame 15. In this manner, the front loader 7 can be attached to and detached from the vehicle body 2 when the sub frame 16 is attached to and detached from the main frame 15. In particular, when the sub frame 16 is attached to the main frame 15, the whole of the entire front loader 7 can be attached to the vehicle body 2 (an attaching state). In addition, when the sub frame 16 is detached from the main frame 15, The main components (components other than the attachment plate 13, the support body 14, and the main frame 15) of the front loader 7 can be detached from the vehicle body 2 (a detaching state).

Hereinafter, referring mainly to FIG. 3 to FIG. 8, the structure for attachment and detachment of the front loader 7 (an attachment detachment structure of the front loader 7) will be described in detail.

Although FIG. 3 to FIG. 8 illustrate a structure on a side of the left frame 8L, the structure on a side of the right frame 8R is similar to the structure on the left frame 8L side. In addition, in order to show the inside of the sub frame 16, an outer sub frame 16B is not illustrated in FIG. 4, and the outer sub frame 16B is represented by an imaginary line in FIG. 5, FIG. 7, and FIG. 8.

As shown in FIG. 3 to FIG. 7, the main frame 15 is provided with a first engaging portion 30. The first engaging portion 30 is formed to be recessed downward from the upper portion of the main frame 15. The first engaging portion 30 is recessed in a shape that gradually widens from the lower side to the upper side. The first engaging portion 30 has a notched portion 31 and a receiving tool 32 fixed to the upper portion of the notched portion 31.

Figure 6:
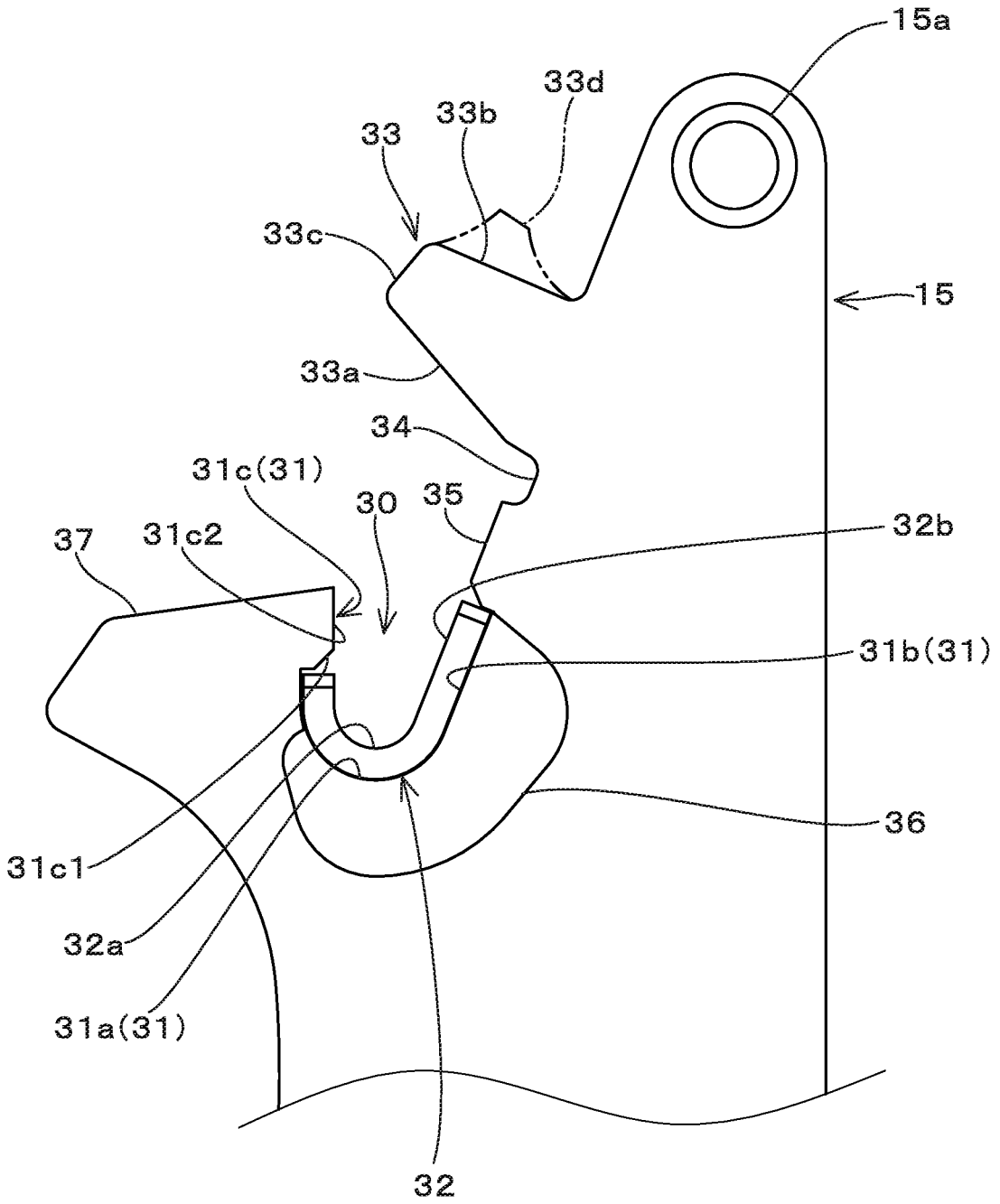
FIG. 6 is an enlarged side view illustrating an upper portion of the main frame according to the embodiment.

As shown in FIG. 6 and the like, the notched portion 31 is formed by cutting the upper edge of the main frame 15 downward. The notched portion 31 has an arc portion 31*a*, an inclining portion 31*b*, and an extending portion 31*c*. The arc portion 31*a* is formed in an arc shape convex downward. The inclining portion 31*b* extends obliquely upward and backward from the upper end of the arc portion 31*a* on the rear side. The extending portion 31*c* extends backward from the upper end of the arc part 31*a* on the front side. The extending portion 31*c* has a first edge 31*c*1 and a second edge 31*c*2. The first edge portion 31*c*1 extends obliquely upward and backward from the upper end of the arc portion 31*a* on the front side. The second edge 31*c*2 extends upward from the upper end of the first edge 31*c*1. In particular, the second edge 31*c*2 is gradually shifted backward as the second edge 31*c*2 extends upward from the upper end of the first edge 31*c*1.

An inclining surface 37 is provided in front of the notched portion 31. The inclining surface 37 linearly extends forward from the upper end of the second edge 31*c*2. The inclining surface 37 is gradually shifted downward as the inclining surface 37 separates away from the upper end of the second edge 31*c*2 (as it extends forward).

Figure 5:
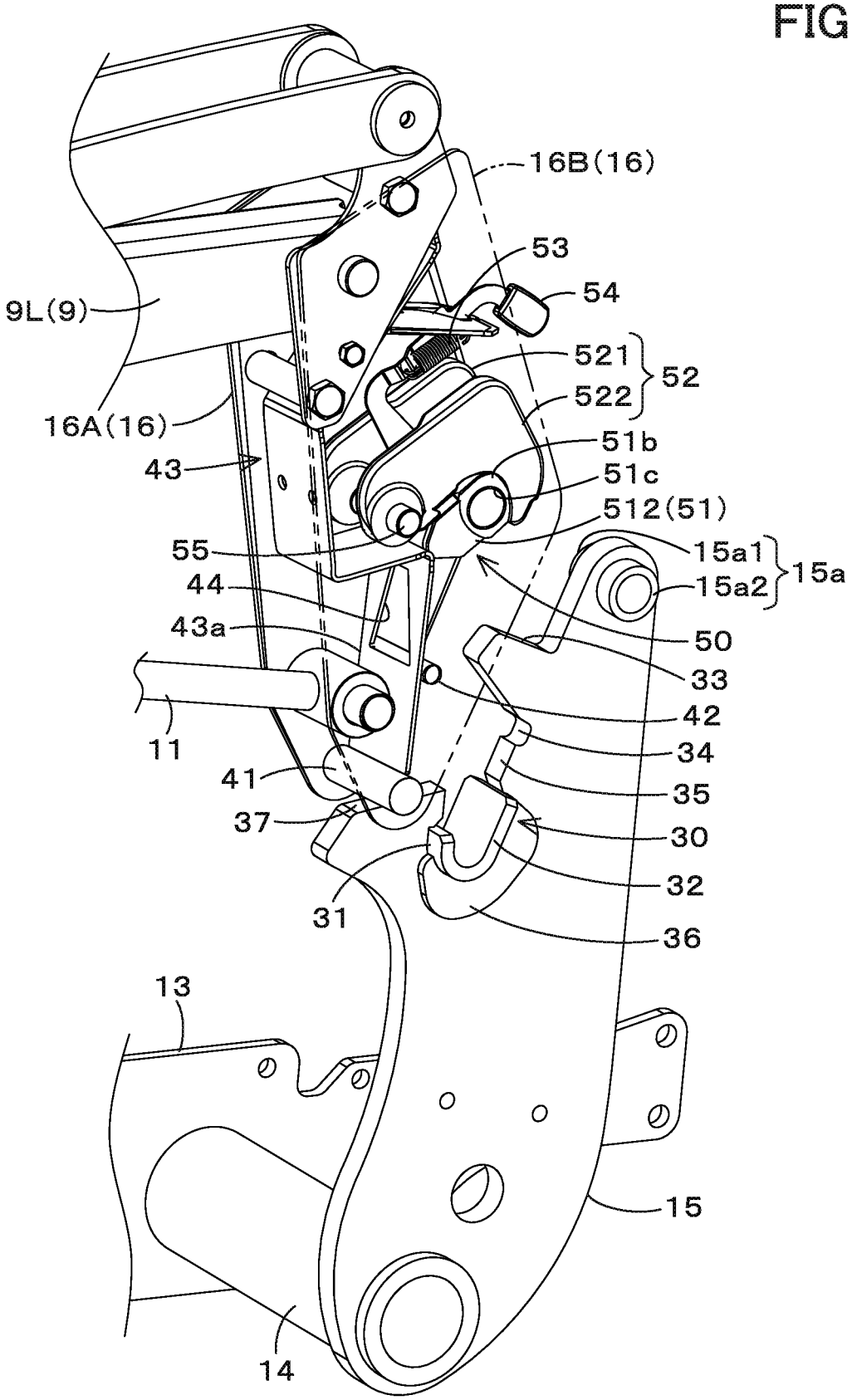
FIG. 5 is a front perspective view illustrating the main frame and the sub frame according to the embodiment (an initial state)

The receiving tool 32 is a plate material bent in a J-shape in a side view. The receiving tool 32 is arranged along the arc portion 31*a* and the inclining portion 31*b* of the notched portion 31. As shown in FIG. 5, the width (a length in the machine width direction) of the receiving tool 32 is wider than the width (a plate thickness of the main frame 15) of the notched portion 31. In this manner, the second engaging part 41 mentioned below can be caught certainly.

The upper surface (a surface opposite to the surface facing the notched portion 31) of the receiving tool 32 has an arc portion 32*a* and an inclining portion 32*b*. The arc portion 32*a* is formed in an arc shape convex downward. The inclining portion 32*b* extends obliquely upward and backward from the upper end of the arc portion 32*a* on the rear side. The front portion of the arc portion 31*a* extends upward, and the second edge portion 31*c*2 is located on the extension line of the front portion.

The lower surface of the receiving tool 32 is supported by the notched portion 31 and the support plate 36. The support plate 36 is fixed to both of the left surface and the right surface of the main frame 15. The upper surface of the support plate 36 has a shape spreading along the lower surface of the receiving tool 32. The support plate 36 supports the lower surface of the receiving tool 32 at the portion protruding leftward and rightward from the notched portion 31.

Figure 4:
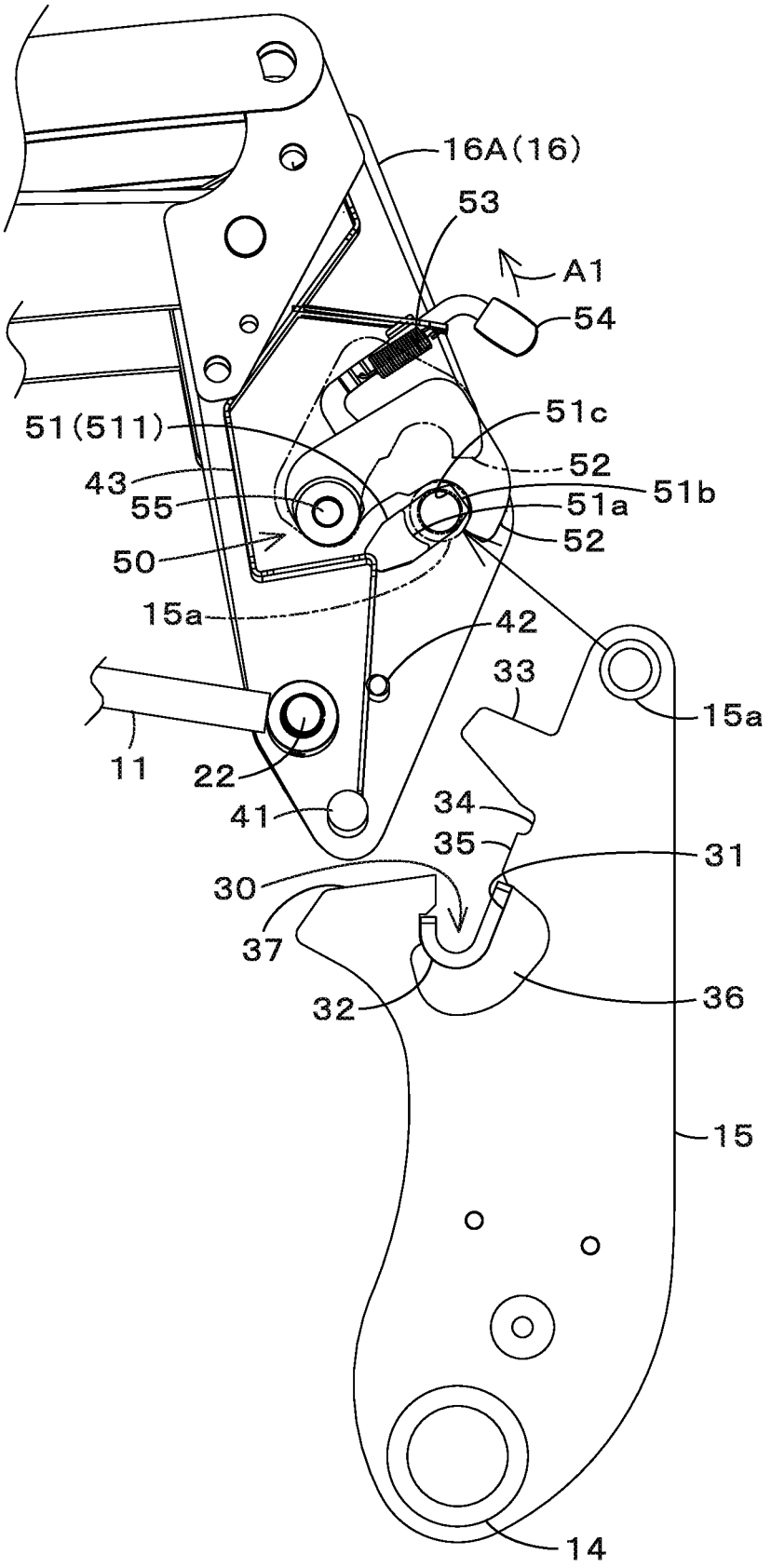
FIG. 4 is a side view illustrating the main frame and the sub frame according to the embodiment.

As shown in FIG. 3 to FIG. 5 and the like, the sub frame 16 is provided with a second engaging portion 41. The second engaging portion 41 is provided at the lower portion of the sub frame 16. The second engaging portion 41 is a cylindrical shaft extending in the machine width direction. The second engaging portion 41 couples the inner sub frame 16A to the outer sub frame 16B. The radius of the shaft constituting the second engaging portion 41 is smaller than the curvature radius of the arc portion 31*a* of the first engaging portion 30 and the curvature radius of the arc portion 32*a* of the receiving tool 32.

Figure 7:
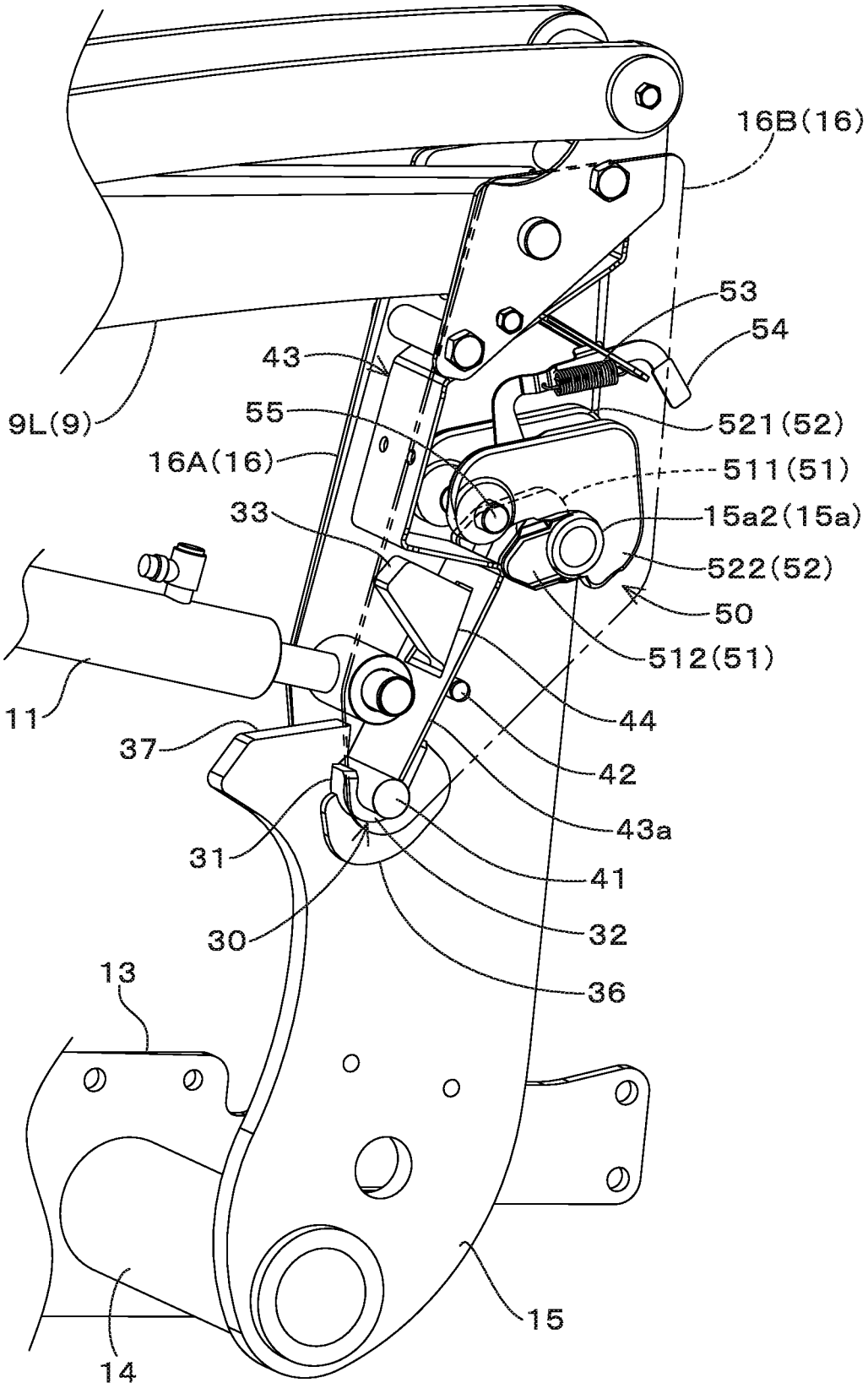
FIG. 7 is a front perspective view illustrating the main frame and the sub frame according to the embodiment (an attaching state)

As shown in FIG. 7, when the sub frame 16 is attached to the main frame 15, the shaft constituting the second engaging portion 41 is engaged with the first engaging portion 30. The second engaging portion (a shaft body) 41 enters the notched portion 31 and is supported by the receiving tool 32 under a state the second engaging portion 41 is engaged with the first engaging portion 30.

The above-mentioned shape of the first engaging portion 30 and the above-mentioned shape of the second engaging portion 41 may be replaced by each other. That is, the first engaging portion 30 may serve as the shaft, and the second engaging portion 41 may serve as the notch. In other words, the main frame 15 may be provided with the shaft, and the sub frame 16 may be provided with the notch.

As shown in FIG. 3 to FIG. 5 and FIG. 7, the sub frame 16 is provided with a guide pin 42. The guide pin 42 is arranged behind and above the second engaging portion 41. The guide pin 42 is a cylindrical shaft extending in the machine width direction. The guide pin 42 couples the inner sub frame 16A to the outer sub frame 16B. The diameter of the shaft constituting the guide pin 42 is smaller than the diameter of the shaft constituting the second engaging portion 41. The guide pin 42 moves relatively with respect to the main frame 15 together with the second engaging portion 41 in the process of attaching the sub frame 16 to the main frame 15.

In addition, although it is preferred that the sub frame 16 is provided with the guide pin 42 mentioned above, it is not necessary to provide the guide pin 42. Furthermore, the sub frame 16 may be provided with a guide protrusion instead of the guide pins 42, the guide protrusion having the function same as the function of the guide pins 42.

As shown in FIG. 4 to FIG. 7, the main frame 15 is provided with a guide portion 33. The guide portion 33 guides the second engaging portion 41 into engagement with the first engaging portion 30. In particular, the guide portion 33 guides the second engaging portion 41 to the direction of engagement with the first engaging portion 30 by being inserted into the opening portion 44 described below. In addition, the guide portion 33 also guides the second engaging portion 41 to the direction of engagement with the first engaging portion 30 by guiding the movement of the guide pin 42 (the relative movement with respect to the main frame 15).

The guide portion 33 is a protruding portion that protrudes forward from the main frame 15 (toward the front in a vehicle longitudinal direction). Hereinafter, the guide portion 33 may be referred to as a protruding portion 33. The guide portion 33 protrudes diagonally upward and forward from the upper portion of the main frame 15. The width of the guide portion 33 in a side view is gradually narrowed from the base end side (the root side) in the protruding direction toward the tip end side. In the case of the present embodiment, the guide portion 33 has a trapezoidal shape in the side view, but may have a triangular shape in the side view.

The guide portion 33 is arranged below the boss 15*a*. The guide portion (the protruding portion) 33 is arranged above the first engaging portion 30. The guide portion 33 is arranged backward of the inclining surface 37. The tip of the guide portion 33 is located above the notched portion 31.

As shown in FIG. 6, the guide portion (the protruding portion) 33 has a lower surface 33*a*, an upper surface 33*b*, and a front surface 33*c*. The lower surface 33*a* is inclined gradually downward as the lower surface 33*a* extends backward. The front end of the lower surface 33*a* is located above the notched portion 31. The rear end of the lower surface 33*a* is located backward of the notched portion 31.

The lower surface 33*a* is a guide surface to which the guide pin 42 contacts and moves on the surface when the sub frame 16 relatively moves with respect to the main frame 15. Hereinafter, the lower surface 33*a* of the guide portion (protruding portion) 33 may be referred to as a guide surface 33*a*. Both of the second engaging portion 41 and the guide pin 42 are arranged on the sub frame 16, and thus the second engaging portion 41 also moves in synchronization with the movement of the guide pin 42 (the relative movement with respect to the main frame 15). In particular, the guide pin 42 moves contacting to the lower surface 33*a* of the guide portion 33, and thereby the second engaging portion 41 moves in a direction of engagement with the first engaging portion 30 (diagonally backward and downward).

As shown in FIG. 6, the upper surface 33*b* of the guide portion 33 is inclined extending backward and gradually downward. The inclination of the upper surface 33*b* is gentler than the inclination of the lower surface 33*a*. In other words, the upper surface 33*b* is almost horizontal in comparison with the lower surface. The upper surface 33*b* may be provided with a bulging portion 33*d* as shown by a vertical line. The providing of the bulging portion 33*d* can prevent the guide pin 42 from being placed on the upper surface 33*b*. In this manner, the guide pins 42 to be guided along the lower surface (a guide surface) 33*a* can be prevented from being guided along the upper surface 33*b*.

The front surface 33*c* of the guide portion 33 is inclined gradually shifting backward as the first surface 33*c* extends upward. The front surface 33*c* and the upper surface 33*b* are continuous through smooth curved surface, and the front surface 33*c* and the lower surface 33*a* are also continuous through smooth curved surfaces. Moreover, in the case where the protruding part 33*d* is provided, it is preferable to provide the front end of the bulging portion 33*d* so as to be continuous with the front surface 33*c*.

As shown in FIG. 4 to FIG. 6, the main frame 15 has a concave portion 34. The concave portion 34 is provided at the base end (a root) of the guide portion 33. In particular, the concave portion 34 is provided on an extension of the lower surface 33*a* of the guide portion 33.

The concave portion 34 is recessed diagonally backward and downward. The width of the inlet of the concave portion 34 is larger than the diameter of the guide pin 42. The concave portion 34 catches the guide pin 42 when the second engaging portion 41 is engaged with the first engaging portion 30 (see FIG. 18). The concave portion 34 is provided above the first engaging portion 30. In addition, the concave portion 34 is provided backward of the first engaging portion 30.

The concave portion 34 and the first engaging portion 30 are communicated with each other by the communication portion 35. The communication portion 35 allows the lower end of the concave portion 34 and the upper edge of the first engaging portion 30 to be communicated with each other. The communication portion 35 is inclined shifting forward as the communication portion extends downward. The surface of the inclining portion 32*b* of the receiving tool 32 is arranged on an extension of the lower portion of the communication portion 35.

As shown in FIG. 3 to FIG. 5, FIG. 7, and FIG. 8, the sub frame 16 is provided with a coupling plate 43 that couples the inner sub frame 16A to the outer sub frame 16B. The coupling plate 43 has a function serving as a reinforcing plate for reinforcing the sub frame 16. The coupling plate 43 extends from the lower portion of the sub frame 16 to the upper portion of the sub frame 16.

As shown in FIG. 8, the coupling plate 43 is a plate having a plurality of bent portions. In particular, the coupling plate 43 has a first portion 43*a*, a second portion 43*b*, a third portion 43*c*, a fourth portion 43*d*, and a fifth portion 43*e*. The first portion 43*a* extends upward from the lower portion of the sub frame 16. The second portion 43*b* is bent from the upper end of the first portion 43*a* and extends forward. The third portion 43*c* is bent from the front end of the second portion 43*b* and extends upward. The fourth portion 43*d* is bent from the upper end of the third portion 43*c* and extends backward and upward. The fifth portion 43*e* is bent from the upper end of the fourth portion 43*d* and extends upward.

The second engaging portion (a shaft) 41 is fixed to the coupling plate 43. The second engaging portion 41 is fixed to the lower portion of the coupling plate 43 (the lower portion of the first portion 43*a*). An opening portion 44 is formed in the coupling plate 43. That is, the coupling plate 43 is an opened member in which the opening portion 44 is formed. In other words, the opened member in which the opening portion 44 is formed is the coupling plate 43 that connects the inner sub frame 16A to the outer sub frame 16B. Hereinafter, the coupling plate 43 may be referred to as the opening member 43.

The opening portion 44 is formed in the first portion 43*a*. The opening portion 44 is formed such that the length of the lower portion (a lower edge) 44*a* is wider than the length of the upper portion (an upper edge) 44*b*. The length of the lower portion 44*a* of the opening portion 44 and the length of the upper portion 44*b* of the opening portion 44 are both longer than the length of width (thickness) of the guide portion 33. In the case of the present embodiment, the opening portion 44 is formed in a trapezoidal shape. However, the shape of the opening portion 44 is not limited to the trapezoidal shape, and may be rectangular or square.

A guide portion 33 described later is inserted into the opening portion 44 (see FIG. 7). In particular, when the guide pin 42 moves in the direction in which the second engaging portion 41 is engaged with the first engaging portion 30, the guide portion 33 is inserted into the opening portion 44.

In the process of attaching the sub frame 16 to the main frame 15, the edges (the upper edge 44*a* and the lower edge 44*b*) of the opening portion 44 is contacted to the protruding portion 33 and thereby guides the movement of the sub frame 16 in the direction of insertion of the protruding portion 33 (in the direction in which the protruding portion 33 is inserted to the opening portion).

Meanwhile, the guide portion 33 and the opening portion 44 are arranged on each of the left frame 8L and the right frame 8R. However, the movement of the protruding portion 33 is guided when at least the guide portion 33 arranged on the left or the right is contacted to the edge portion of the opening portion 44.

The opening portion 44 is arranged above the second engaging portion 41. The guide pin 42 is arranged on the edge portion of the opening portion 44. In the present embodiment, the guide pin 42 is fixed along the lower edge 44*a* of the opening portion 44. However, the guide pin 42 may be fixed along the upper edge 44*b* of the opening portion 44. The length of the guide pin 42 is longer than the length of the lower edge 44*a* of the opening portion 44.

Figure 18:
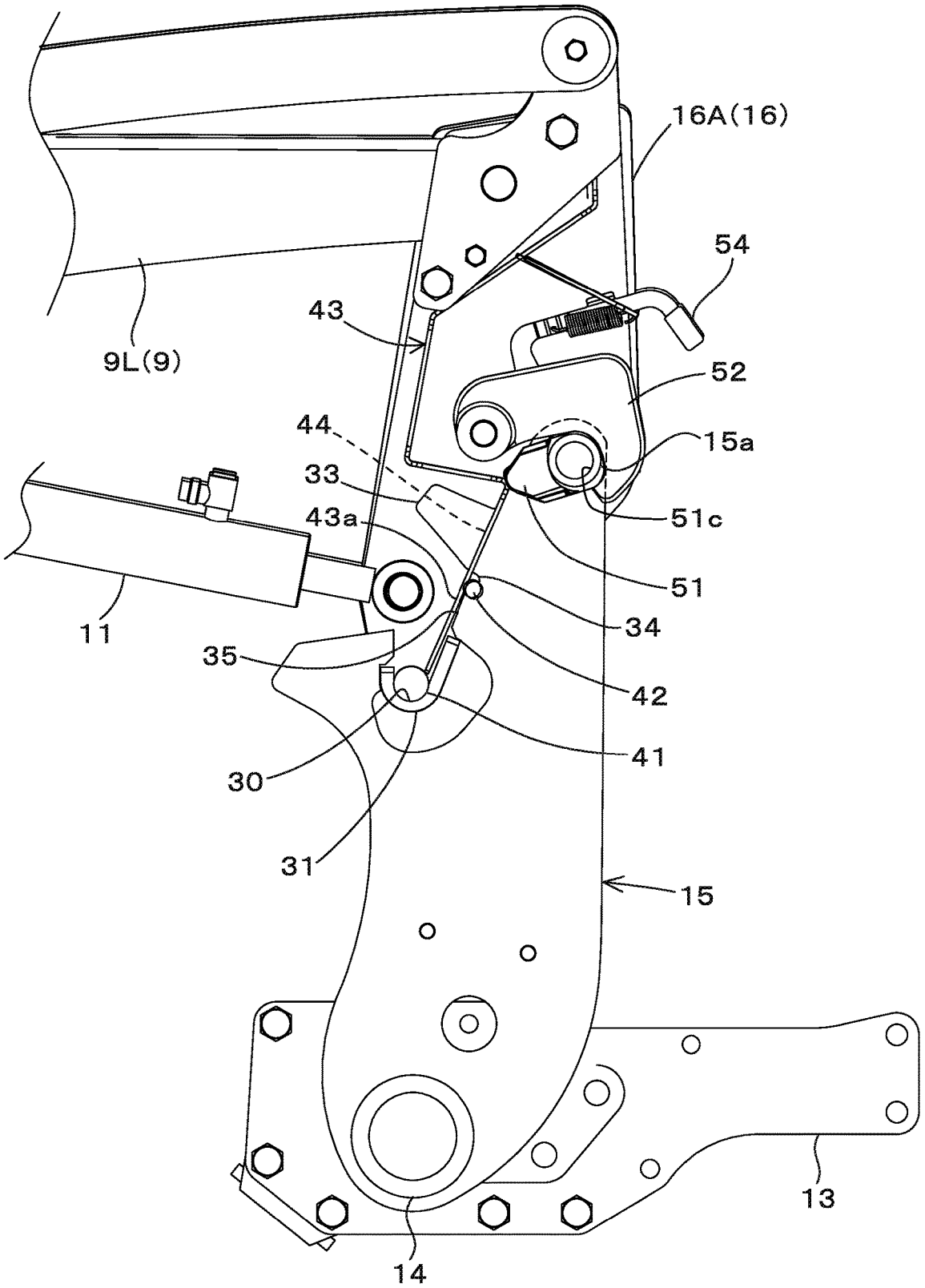
FIG. 18 is a partially-enlarged view of FIG. 17.

When the second engaging portion 41 is engaged with the first engaging portion 30 (when the sub frame 16 is attached to the main frame 15), the first portion 43*a* of the coupling plate 43 is in contact with the coupling portion 35 of the main frame 15 (see FIG. 18).

As shown in FIG. 4, FIG. 5 and FIG. 7, the front loader 7 is provided with a holding mechanism 50 configured to hold the sub frame 16 that is already attached to the main frame 15. The holding mechanism 50 is constituted of a boss 15*a* provided in the main frame 15, a receiving member 51, and a hook 52, the receiving member 51 and the hook 52 being arranged on the sub frame 16.

As shown in FIG. 4 and FIG. 7, the receiving member 51 is a member that receives and supports the outer circumference surface of the boss 15*a* under a state where the sub frame 16 is attached to the main frame 15. In FIG. 4, the position of the boss 15*a* before the sub frame 16 is attached to the main frame 15 is represented by a solid line, and the position for attachment of the boss 15*a* is represented by an imaginary line.

As shown in FIG. 7, the receiving member 51 includes an inner member 511 and an outer member 512. The inner member 511 is provided on the inner surface of the inner sub frame 16A (the surface arranged on the outer sub frame 16B side). The outer member 512 is arranged on the inner surface of the outer sub frame 16B (the surface arranged on the inner sub frame 16A side). The inner member 511 catches the outer circumferential surface of the inner boss 15*a*1. The outer member 512 catches the outer circumferential surface of the outer boss 15*a*2.

As shown in FIG. 4, the receiving member 51 has a contact surface 51 that contacts to the outer circumferential surface of the boss 15*a*. The contact surface 51*a* is formed in an arc shape in a side view. In addition, as shown in FIG. 5, the receiving member 51 has an extended portion 51*b* arranged and extended backward from the contact surface 51*a*. When the second engaging portion 41 is engaged with the first engaging portion 30 (when the sub frame 16 is attached to the main frame 15), a boss 15*a* is arranged between the extended portion 51*b* of the outer member 512 and the extended portion 51*b* of the inner member 511. A through hole 51*c* is formed in the extended portion 51*b*. When the second engaging portion 41 is engaged with the first engaging portion 30, the through hole 51*c* is overlapped with an inner hole of the boss 15*a*. A pin 25 (see FIG. 1 and FIG. 2) penetrating the main frame 15 and the sub frame 16 can be inserted into the through hole 51*c*. A cylindrical boss can be arranged around the through hole 51*c*.

As shown in FIG. 3, FIG. 5 and FIG. 7, the hook 52 includes an inner hook 521 and an outer hook 522. The inner hook 521 is engaged with the outer circumferential surface of the inner boss 15*a*1. The outer hook 522 is engaged with the outer circumferential surface of the outer boss 15*a*2. The inner hook 521 and the outer hook 522 are coupled to each other and are moved integrally.

The hook 52 is supported by a lateral shaft 55 extending in the machine width direction, and is configured to be rotated around the lateral shaft 55. The hook 52 is configured to be moved (turned) between an engaged position (the position indicated by a solid line in FIG. 4) engaged to the outer circumferential surface of the boss 15*a* and a detached position (the position indicated by an imaginary line in FIG. 4) detached from the outer circumferential surface of the boss 15*a*. When the hook 52 is in the engaged position, the sub frame 16 attached to the main frame 15 is held.

The hook 52 is pushed by the biasing member (a spring) 53 in a direction (downward) toward the engaged position. An operating lever 54 is connected to the hook 52. The operation lever 54 is arranged at a position where an operator seated on the operator seat 5 can operate the operation lever 54. When the operation lever 54 is grasped and is operated upward (in the direction indicated by an arrowed line A1 in FIG. 4) against the biasing force of the biasing member 53, the hook 52 can be moved (turned) from the engaged position (the position indicated by the solid line) to the detached position (the position indicated by the imaginary line). The sub frame 16 can be detached from the main frame 15 when the hook 52 is moved (turned) to the detached position.

The attachment detachment structure of the front loader mentioned above is identically employed in the left frame 8L side and in the right frame 8R side. In this manner, the shapes and structures of the components of the main frame 15 and the shapes and structures of the components of the sub frame 16 arranged on the left frame 8L side is similar to the shapes and structures of components arranged on the right frame 8R side, (the components of the main frame 15 including the first engaging portion 30, the guide portion 33, the concave portion 34, and the like), and (the components of the sub frame 16 including the second engaging portion 41, the guide pin 42, the opening portion 44, and the like).

In addition, under the state where the front loader 7 is attached to the vehicle body 2, positions of the components of the main frame 15 and positions of the components of the sub frame 16 arranged on the left frame 8L side is similar to the positions of components arranged on the right frame 8R side with respect to the vehicle body 2 in the longitudinal direction and the vertical direction, (the components of the main frame 15 including the first engaging portion 30, the guide portion 33, the concave portion 34, and the like), and (the components of the sub frame 16 including the second engaging portion 41, the guide pin 42, the opening portion 44, and the like).

<How to Attach and Detach the Front Loader>

The method of attaching and detaching the front loader 7 will be described below.

First, mainly referring to FIG. 9 to FIG. 18, the method of attaching the front loader 7 will be described below. For the sake of simplification of the drawings, FIG. 9 to FIG. 18 illustrate only the left portion (the left frame 8L and the like) of the front loader 7. In addition, illustration of the outer side sub frame 16B is omitted in the drawings.

Figure 9:
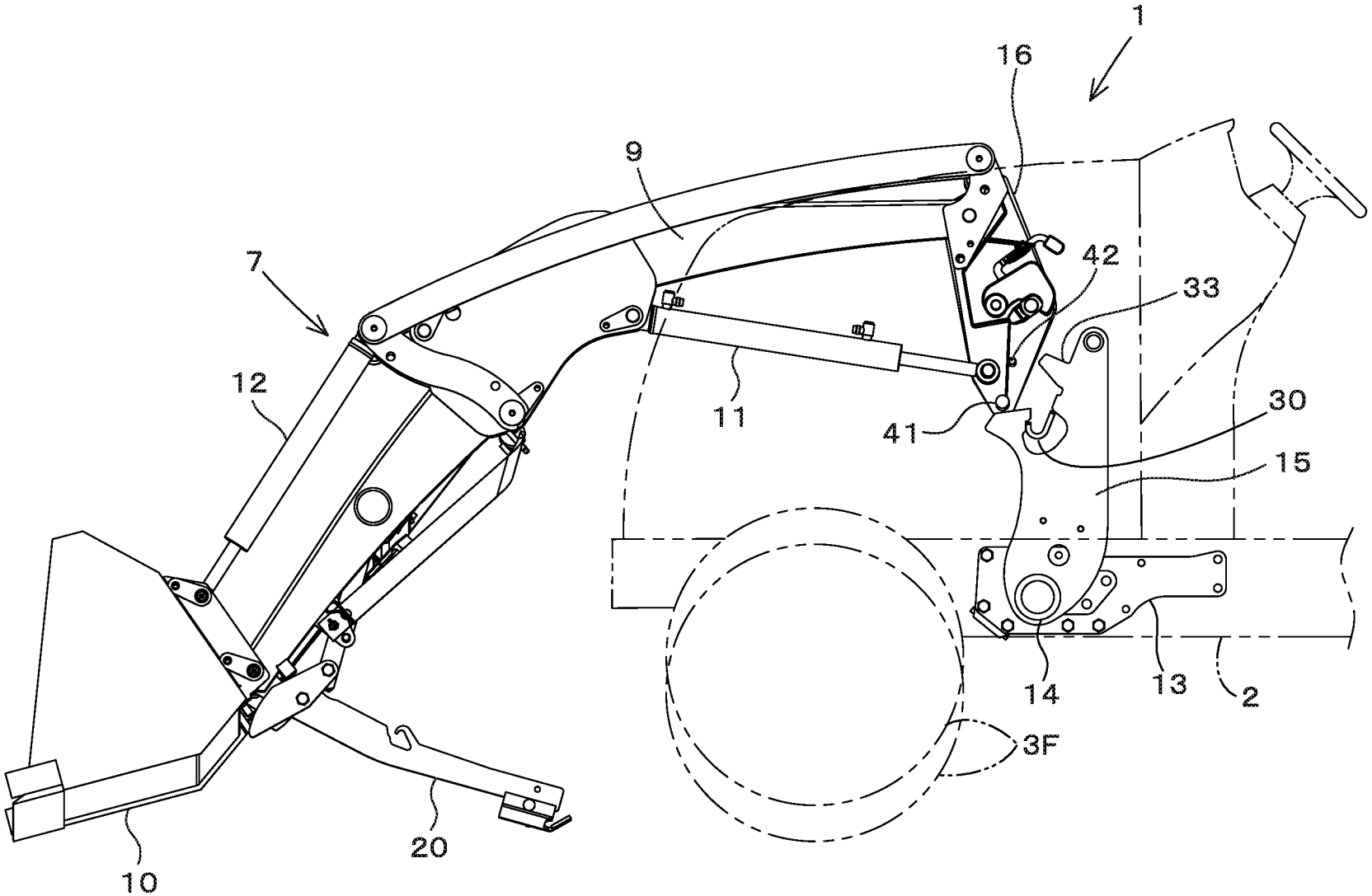
FIG. 9 is a side view illustrating a state (the initial state) before the front loader is attached to a vehicle body according to the embodiment.
Figure 10:
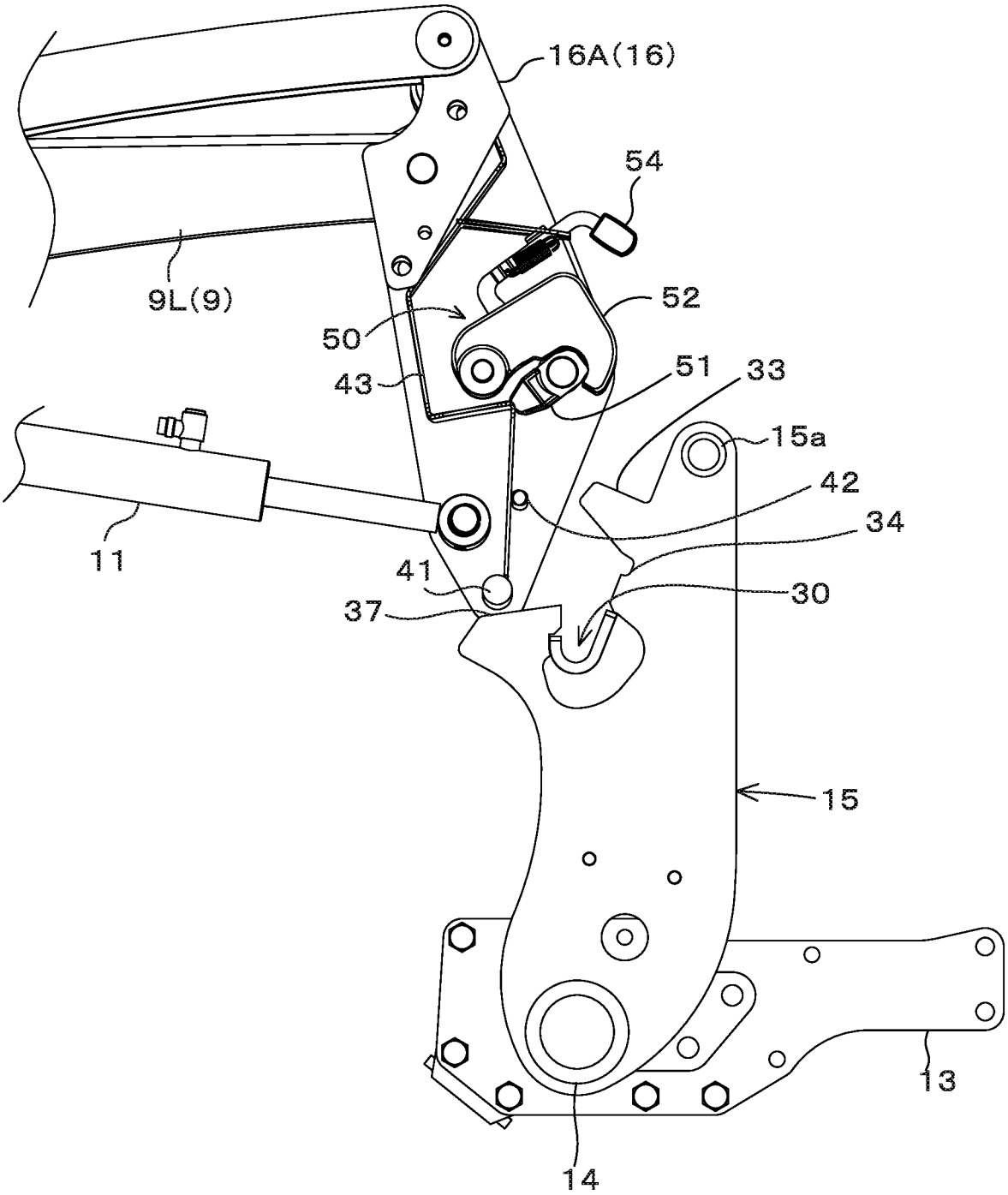
FIG. 10 is a partially-enlarged view of FIG. 9.

FIG. 9 illustrates an initial state of the front loader 7 before the attachment of the front loader 7. In the initial state, the front loader 7 is supported by the stand 20 and is placed on the ground. In addition, the second engaging portion 41 arranged in the sub frame 16 is not engaged with the first engaging portion 30 arranged in the main frame 15. The second engaging portion 41 is located in front of and above the first engaging portion 30. In particular, as shown in FIG. 10, the second engaging portion 41 is placed above the inclining surface 37 located in front of the first engaging portion 30. In addition, the guide pin 42 is located in front of the guide portion 33.

When the vehicle body 2 travels forward and the hydraulic cylinders (the boom cylinder 11 and the bucket cylinder 12) are stretched and shortened from the initial state shown in FIG. 9 and FIG. 10, the second engaging portion 41 can be engaged with the first engaging portion 30. In this manner, the front loader 7 can be attached to the vehicle body 2.

Mainly referring to FIG. 11 to FIG. 18, an operation for attaching the front loader 7 to the vehicle body 2 will be described below. However, FIG. 11 to FIG. 18 show an example of the operation, and the specific operation (the procedure of and the number of stretching and shortening of the hydraulic cylinder and the like) depends on the change of the positional relationship between the main frame 15 and the sub frame 16, and thus may be changed arbitrarily.

Figure 11:
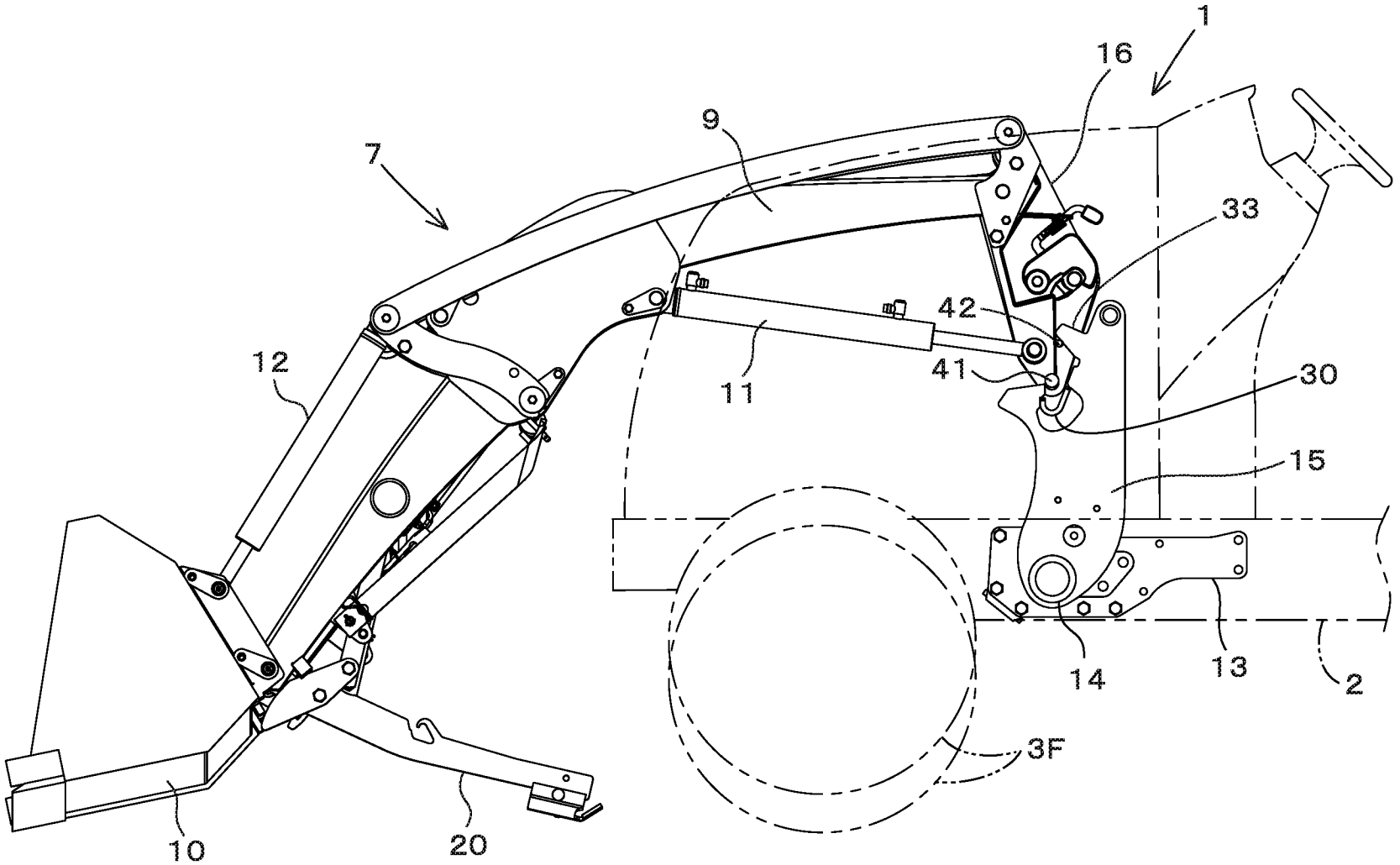
FIG. 11 is a side view illustrating a first step of a process of attaching the front loader to the vehicle body according to the embodiment.
Figure 12:
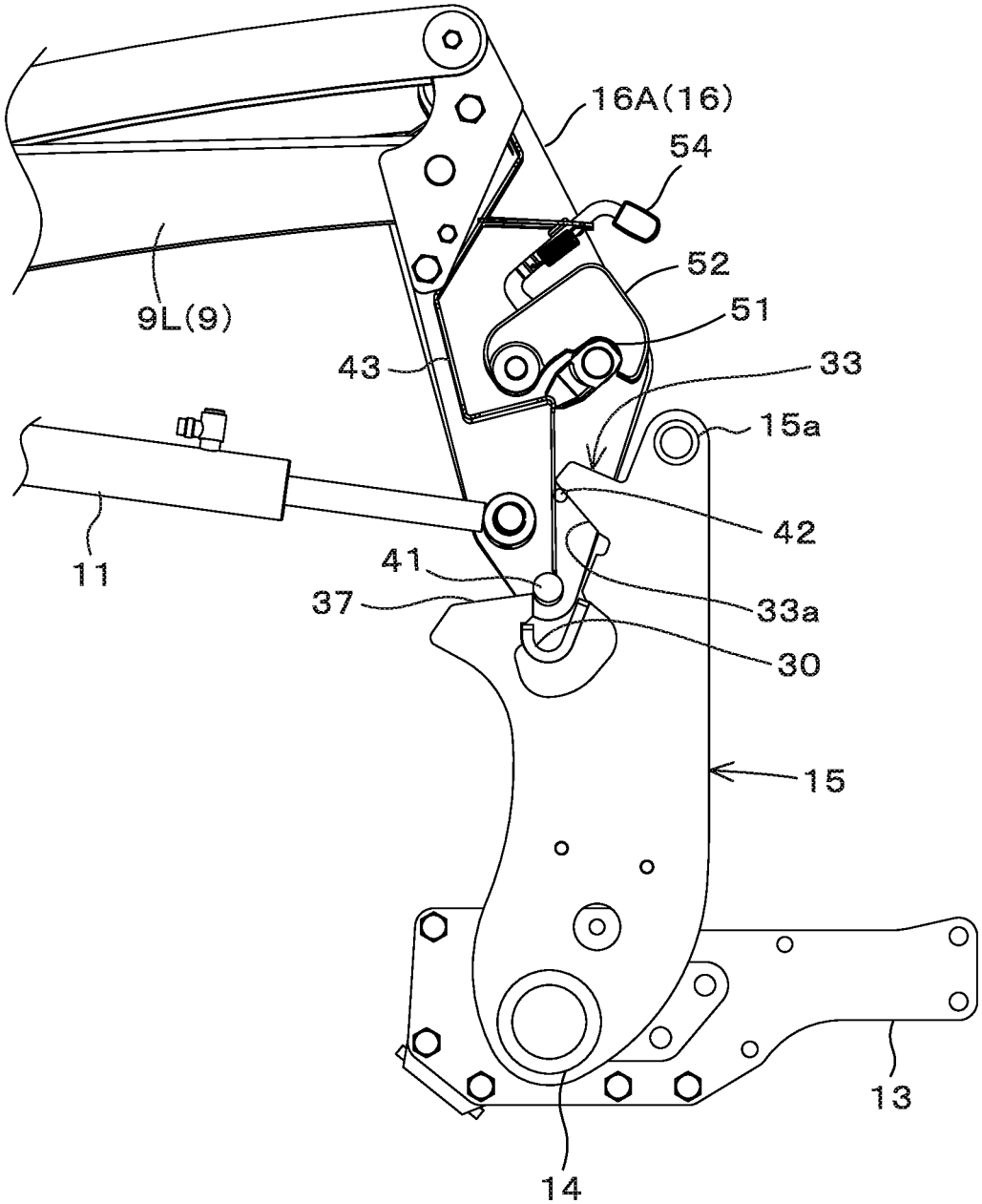
FIG. 12 is a partially-enlarged view of FIG. 11.

First, as shown in FIG. 11 and FIG. 12, the vehicle body 2 travels forward to the front loader 7 from the initial state, and the boom cylinder 11 is stretched and the bucket cylinder 12 is shorten. In this manner, the second engaging portion 41 moves relatively to the first engaging portion 30, and reaches the upper position of the first engaging portion 30. In addition, the guide pin 42 moves relatively to the guide portion 33, and contacts to the lower surface 33*a* of the guide portion 33.

Figure 13:
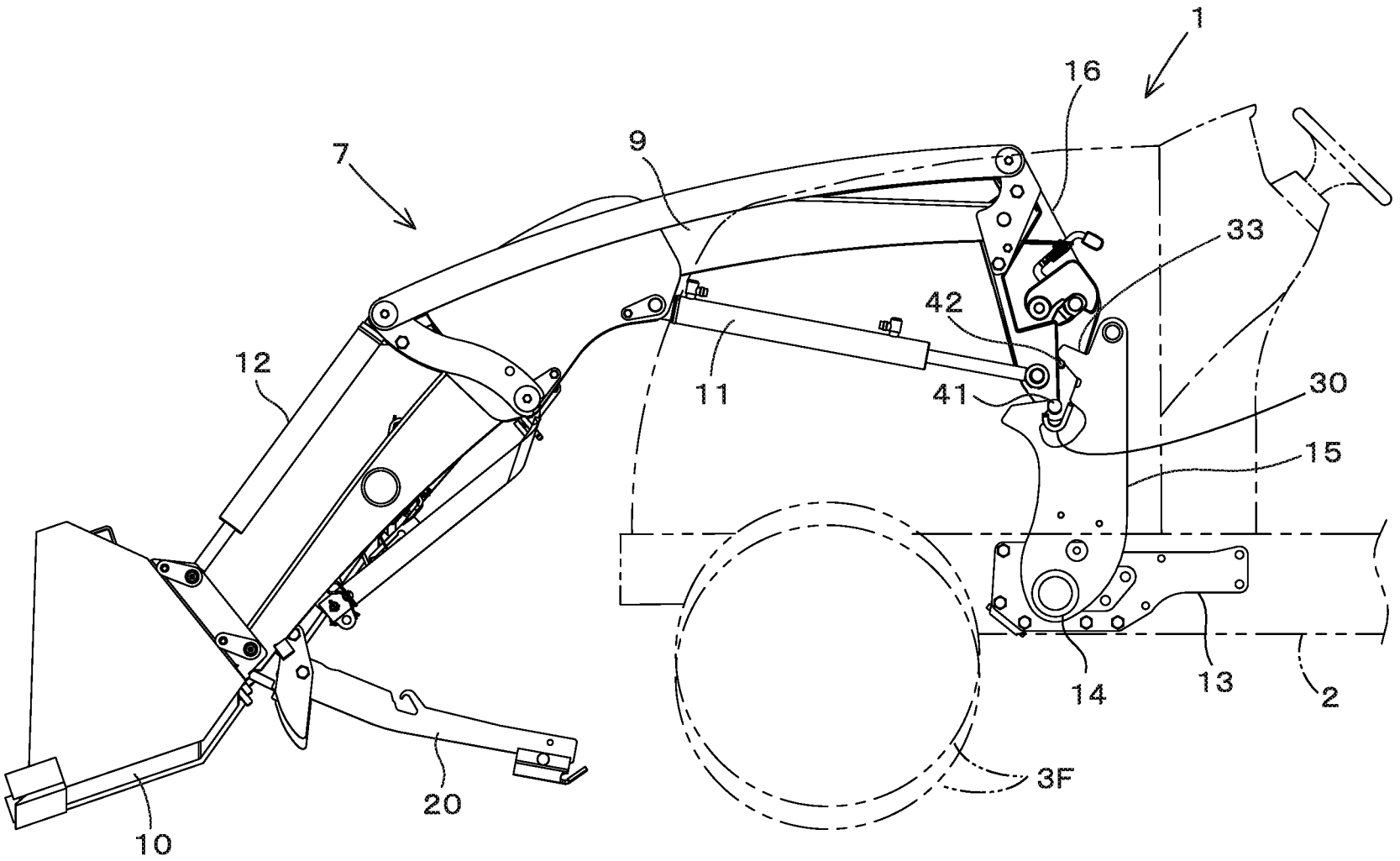
FIG. 13 is a side view illustrating a second step of the process of attaching the front loader to the vehicle body according to the embodiment.
Figure 14:
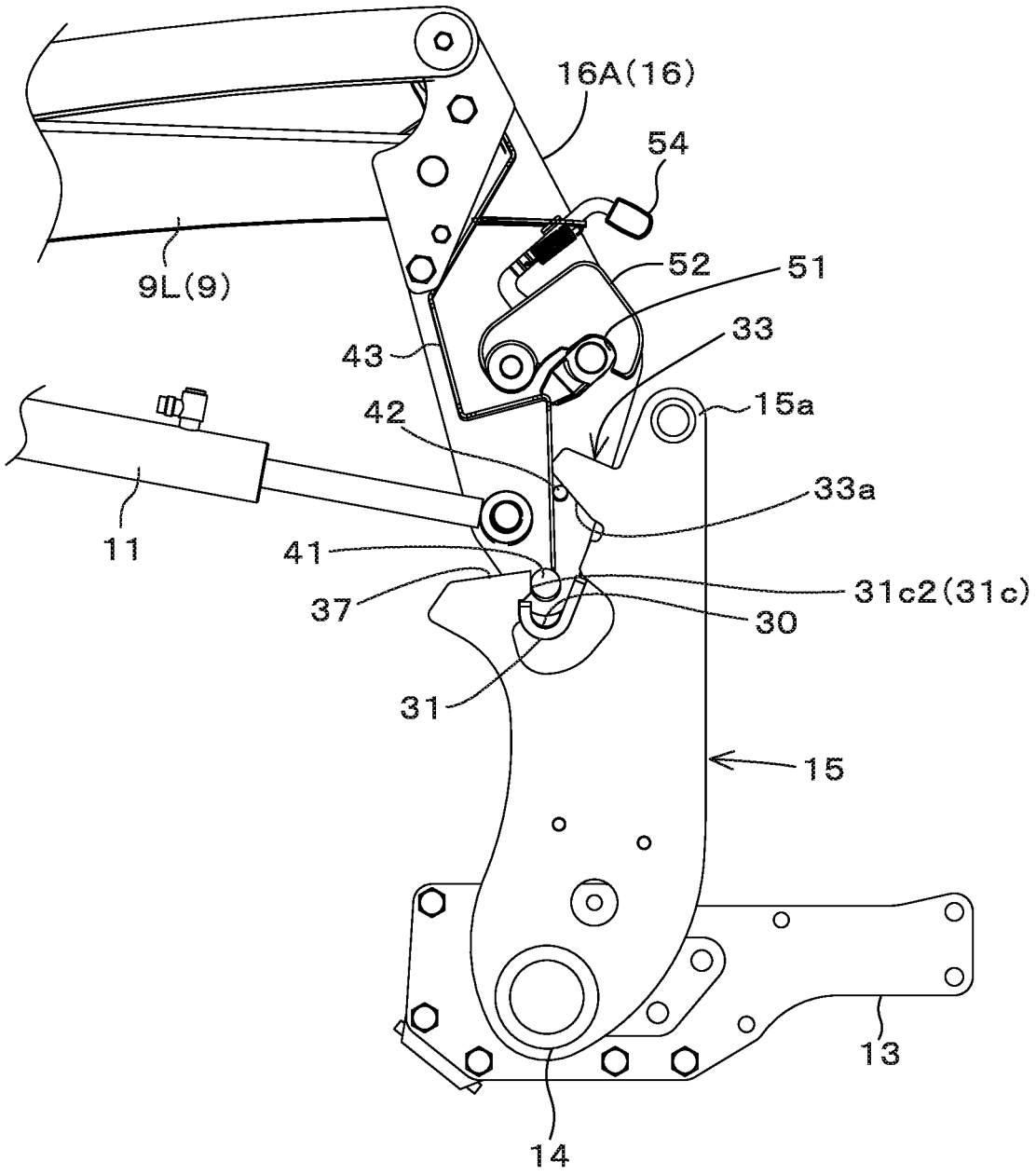
FIG. 14 is a partially-enlarged view of FIG. 13.

Then, as shown in FIG. 13 and FIG. 14, when the boom cylinder 11 and the bucket cylinder 12 are stretched, the guide pin 42 moves backward and downward along the lower surface 33*a* while contacting to the lower surface 33*a* of the guide portion 33. In addition, the second engaging portion 41 moves downward in accordance with the movement of the guide pin 42 and enters the notched portion 31 of the first engaging portion 30, and then the second engaging portion 41 moves downward along the second edge 31*c*2 of the extending portion 31*c*.

Figure 15:
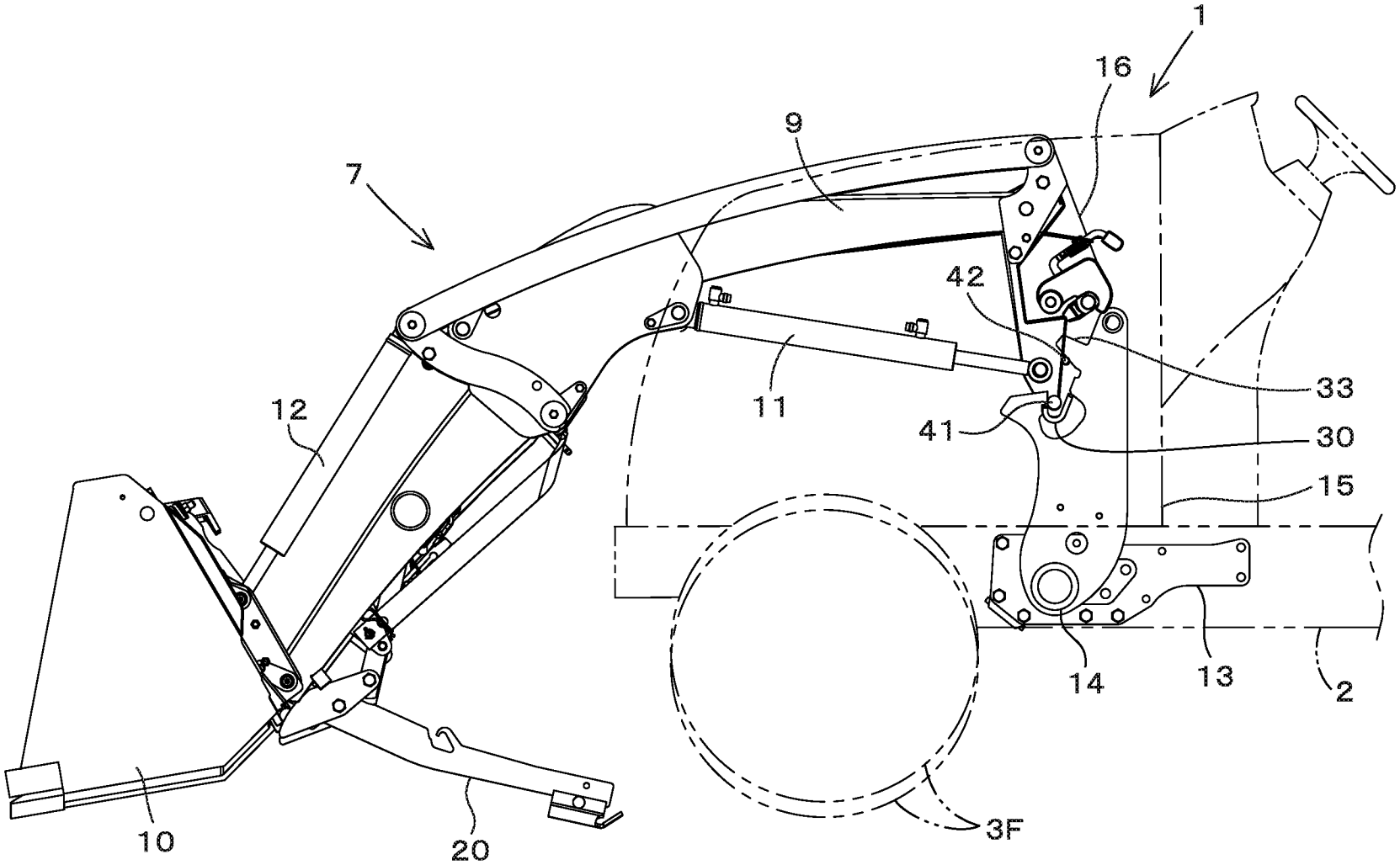
FIG. 15 is a side view illustrating a third step of the process of attaching the front loader to the vehicle body according to the embodiment.
Figure 16:
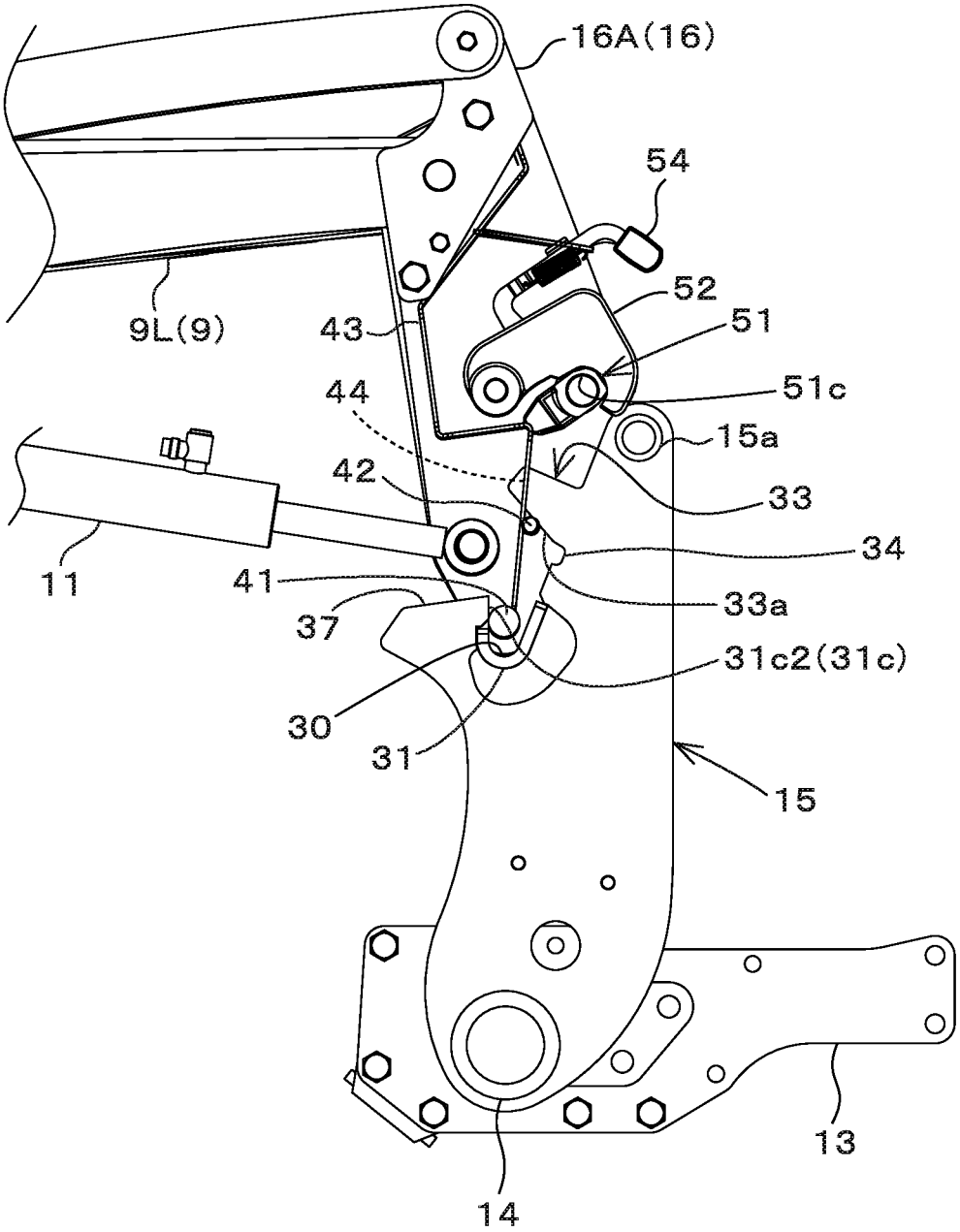
FIG. 16 is a partially-enlarged view of FIG. 15.

Next, as shown in FIG. 15 and FIG. 16, when the boom cylinder 11 and the bucket cylinder 12 are shortened, the guide pin 42 moves further backward and downward along the lower surface 33*a* while contacting to the lower surface 33*a* of the guide portion 33. In addition, the second engaging portion 41 moves further downward along the second edge 31*c*2 of the extending portion 31*c* in accordance with the movement of the guide pin 42. Then, the coupling plate (an opening member) 43 moves relatively to the guide portion 33 together with the guide pin 42. In this manner, the guide portion 33 moves while contacting to the edge portion (the lower edge 44*a* or the upper edge 44*b*) of the opening portion 44, and the tip portion of the guide portion 33 is inserted into the opening portion 44 of the coupling plate (the opening member) 43.

Here, in the case where the vehicle body 2 is inclined with respect to the front loader 7, one of the guide portion 33 on the left side and the guide portion on the right side contacts to the edge portion of the opening portion 44. However, the other may be free from the contact. Even in that case, the movement of the guide portion 33 is guided by the edge portion 44 of the opening portion 44 when at least one of the guide portion 33 on the left and the guide portions 33 on the right contacts to the edge portion of the opening portion 44, and thus both of the guide portions 33 can be surely inserted into the opening portion 44.

Figure 17:
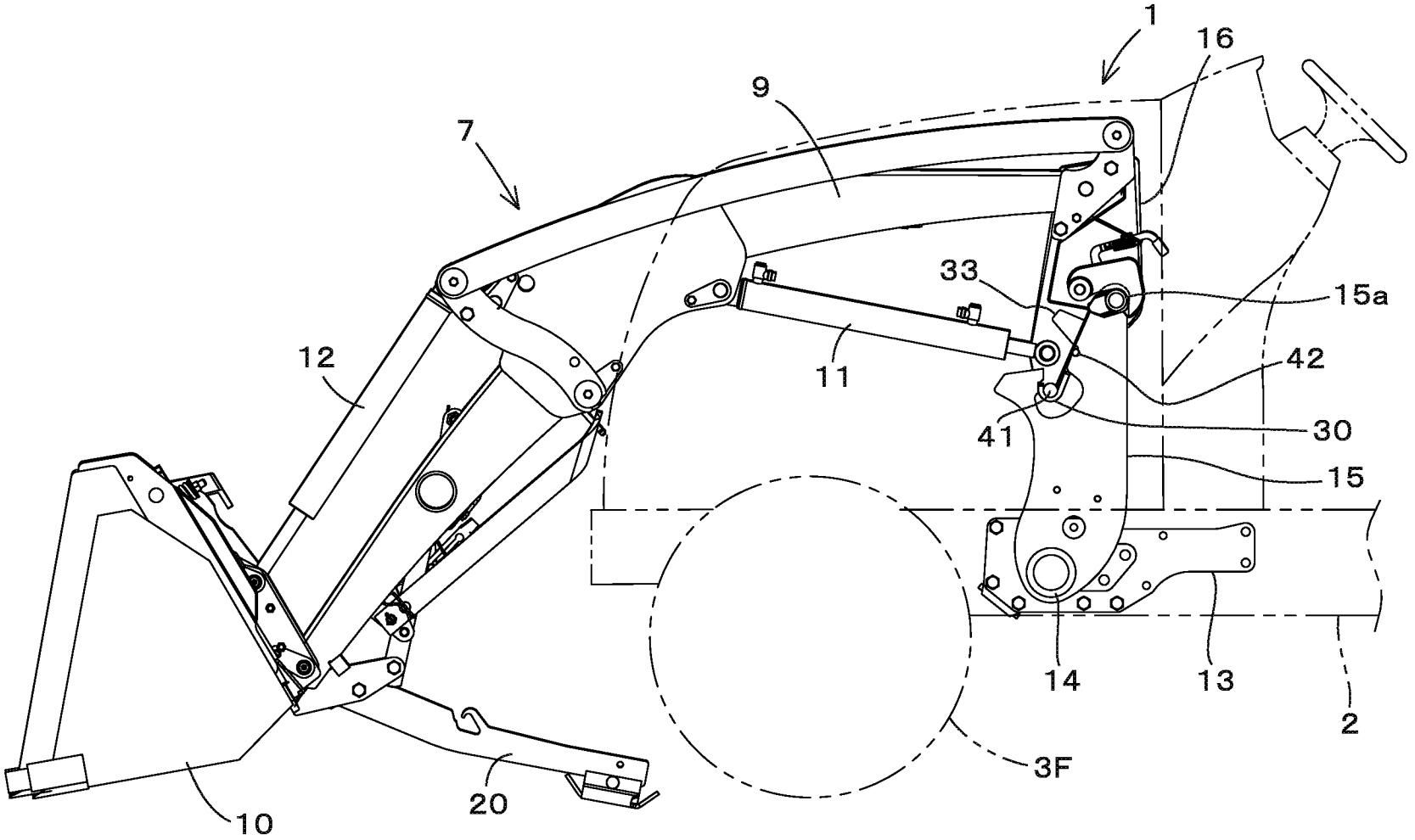
FIG. 17 is a side view illustrating a state (the attaching state) after the front loader is attached to the vehicle body according to the embodiment.

Then, as shown in FIG. 17 and FIG. 18, the guide pin 42 is moved further backward along the lower surface 33*a* of the guide portion 33 when the boom cylinder 11 is shortened and the bucket cylinder 12 is stretched, and thereby the guide pin 42 enters the concave portion 34. In addition, the second engaging portion 41 moves further downward in accordance with the movement of the guide pin 42, and thereby contacts to the receiving tool 32. In this manner, the second engaging portion 41 is engaged with the first engaging portion 30. When the second engaging portion 41 is engaged with the first engaging portion 30, the inner hole of the boss 15*a* of the main frame 15 is overlapped with the through hole 16*a* of the sub frame 16 (the central axis of the boss 15*a* is identical with the central axis of the through hole 16*a*). In addition, as shown in FIG. 7, the guide portion 33 is inserted into the opening portion 44 of the coupling plate (the opening member) 43 almost up to the base end portion (a root) of the guide portion.

In the transition process from the state of FIG. 16 to the state of FIG. 18, the guide portion 33 is inserted into the opening portion 44 of the coupling plate (the opening member) 43, and thereby the movement direction of the sub frame 16 is restricted to be a constant direction (the direction in which the second engaging portion 41 is led to the engagement with the first engaging portion 30) with respect to the main frame 15. In particular, the guide portion 33 moves while being in contact with the edge portions (the lower edge 44*a* and the upper edge 44*b*) of the opening portion 44, and thereby the movement direction of the guide portion 33 is restricted to be a constant direction (the direction in which the second engaging portion 41 is led to the engagement with the first engaging portion 30).

In the transition process from the state of FIG. 16 to the state of FIG. 18, the hook 52 is pushed by the boss 15*a* and turns upward to move toward the detached position. In this manner, the boss 15*a* and the through hole 16*a* are allowed to approach with each other. When the inner hole of the boss 15*a* moves to a position where the inner hole is overlapped with the through hole 16*a*, the hook 52 is returned to the engaged position by the biasing force of the biasing member 53, and is engaged with the boss 15*a* (see FIG. 18). In this manner, the sub frame 16 is coupled to the main frame 15. As the result, a whole of the front loader 7 is attached to the vehicle body 2.

In the state shown in FIG. 17 and FIG. 18 where the second engaging portion 41 is engaged with the first engaging portion 30, the inner hole of the boss 15*a* of the main frame 15, the through hole 16*a* of the sub frame 16, and the through holes 51*c* of the receiving member 51 are overlapped with each other. In this manner, the pin 25 can be inserted into the boss 15*a*, the through hole 16*a*, and the through hole 51*c* (see FIG. 1 and FIG. 2). The insertion of the pin 25 allows the sub frame 16 to be coupled more firmly to the main frame 15.

As described above, according to the front loader 7 of the present embodiment, the guide portion 33 is inserted into the opening portion 44 of the coupling plate (the opening member) 43, and thereby the second engaging portion 41 is guided in the direction of being engaged with the first engaging portion 30. In addition, the movement of the guide pin 42 is guided by the guide portion 33 arranged on the main frame 15, and thereby the second engaging portion 41 is guided in the direction in which the second engaging portion 41 is engaged with the first engaging portion 30. In other words, the guide portion 33 is inserted into the opening portion 44 and guides the movement of the guide pin 42, and thereby the position of the second engaging portion 41 in the vertical direction is adjusted in the direction of approaching the first engaging portion 30.

Figure 19:
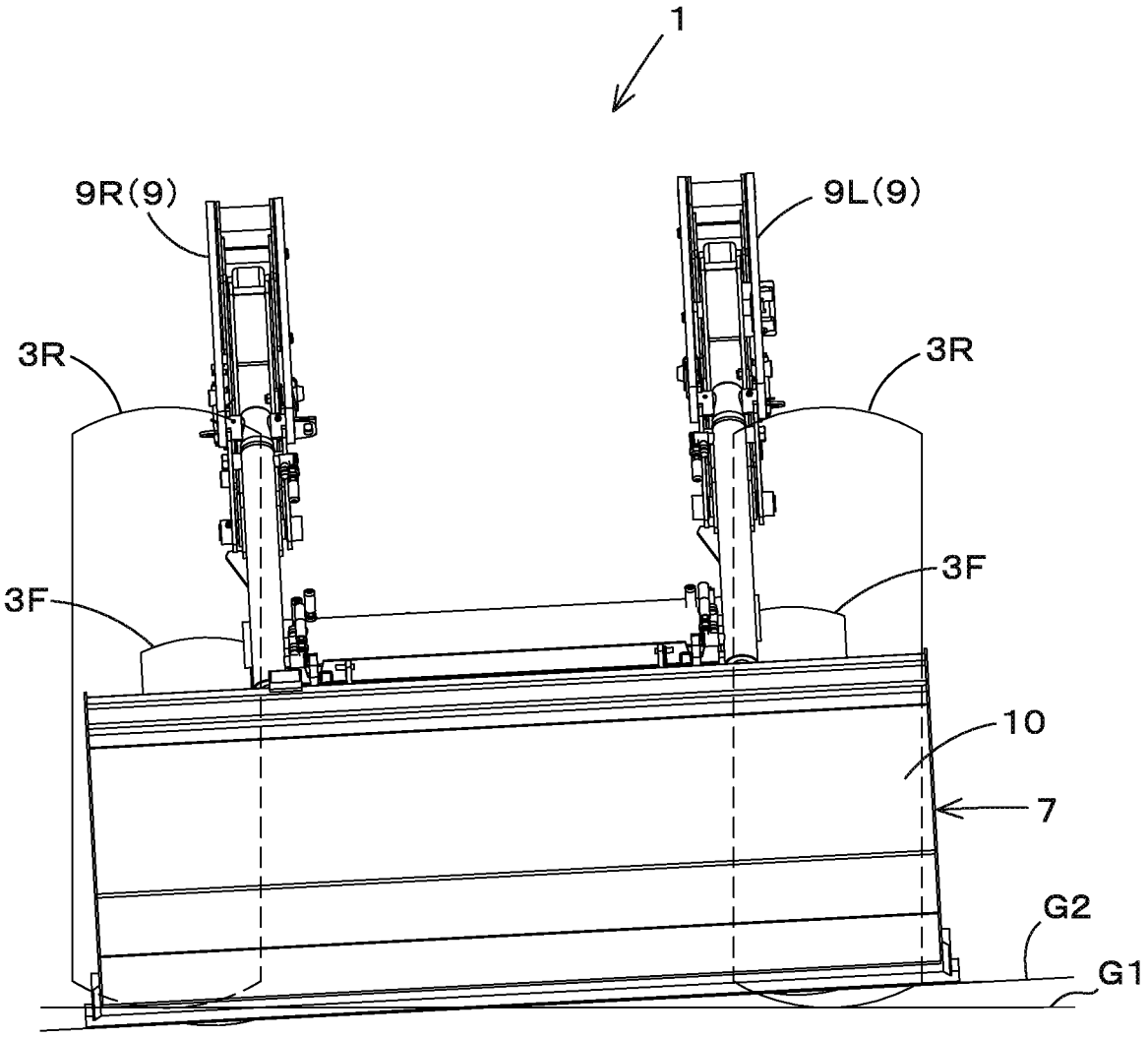
FIG. 19 is a front view illustrating a state where the vehicle body inclines with respect to the front loader according to the embodiment.

In this manner, even in the case where the vehicle body 2 is inclined with respect to the front loader 7 (for example, when the ground surface G1 of the front loader 7 is inclined with respect to the ground surface G2 of the traveling device 3 as shown in FIG. 19), the second engaging portion 41 is guided in the direction of being engaged with the first engaging portion 30 on both of the left side and the right side. In other words, even in the case where the difference between the heights (the vertical positions) of the first engaging portion 30 and the second engaging portion 41 differs between the left side and the right side in the initial state (the state where the front loader is not attached yet), the vertical positions of the second engaging portion 41 are adjusted, on both the left side and the right side, in the direction in which the second engaging portion 41 approaches the first engaging portion 30. As the result, the second engaging portion 41 can be surely engaged with the first engaging portion 30, and the front loader 7 can be easily attached to the vehicle body 2.

The fact that the front wheels 3F on the left side and the right side are different in height in FIG. 9, FIG. 11, FIG. 13, and FIG. 15 represents that the vehicle body 2 is inclined with respect to the front loader 7. The vertical position of the second engaging portion 41 is adjusted on both of the left side and the right side of the vehicle body 2 in the direction of approaching the first engaging portion 30 in the process of attaching the front loader 7 to the vehicle body 2, and thereby the inclination of the vehicle body 2 with respect to the front loader 7 becomes gradually smaller, and then the inclination is eliminated when the front loader 7 is attached to the vehicle body 2 (see FIG. 17).

In the case where the front loader 7 is detached from the vehicle body 2, the operation lever 54 is operated upward against the biasing force of the biasing member 53, and thereby the hook 52 is moved from the engaged position to the detached position. As the result, the sub frame 16 can be detached from the main frame 15. Subsequently, the hydraulic cylinder is stretched and shortened and the vehicle body 2 is moved (in place of the forward traveling, the backward traveling is performed) in the reversed procedure of the above-mentioned attachment method. In this manner, the engagement between the second engaging portion 41 and the first engaging portion 30 can be released, and then the front loader 7 can be detached from the vehicle body 2.

<Effect>

The effects provided by the front loader 7 and the working machine 1 according to the above-described embodiment will be described below.

The front loader 7 includes the boom 7, the main frame 15 attached to the vehicle body 2, the sub frame 16 supporting the boom 9, the sub frame 16 being attached to the main frame 15 and configured to be detached from the main frame 15. The front loader 7 further includes the first engaging portion 30 provided on the main frame 15, the second engaging portion 41 provided on the sub frame 16 and configured to be engaged with the first engaging portion 30 when the sub frame 16 is attached to the main frame 15, the guide portion 33 provided on the main frame 15 and configured to guide the second engaging portion 41 to be engaged with the first engaging portion 30, and the opening member 43 provided on the sub frame 16 and provided with the opening portion 44 to which the guide portion 33 is inserted when the second engaging portion 41 is engaged with the first engaging portion 30.

According to that configuration, the guide portion 33 arranged on the main frame 15 is inserted into the opening portion 44 provided on the sub frame 16 side, and thereby the second engaging portion 41 is led to the engagement with the first engaging portion 30. In this manner, even when the vehicle body 2 is inclined with respect to the front loader 7, the second engaging portion 41 is led to the engagement with the first engaging portion 30 on both of the left side and the right side. As the result, the second engaging portion 41 can be surely engaged with the first engaging portion 30, and the front loader 7 can be easily attached to the vehicle body 2.

Further, the guide portion 33 is a protruding portion protruding forward from the main frame 15 in the front-rear direction of the vehicle body 2.

According to that configuration, when the main frame 15 moves forward to the sub frame 16, the guide portion (the protruding portion) 33 provided on the main frame 15 can be easily inserted to the opening portion 44 arranged on the sub frame 16 side.

Further, an edge portion of the opening portion 44 provided in the opening member 43 contacts to the protruding portion 33 and thereby guides the protruding portion 33 to be moved in an insertion direction of the protruding portion 33 in a process for attaching the sub frame 16 to the main frame 15.

According to that configuration, the protruding portion 33 is guided by the edge portion of the opening portion 44 so as to move in the direction of being inserted into the opening portion 44 in the process of attaching the sub frame 16 to the main frame 15, thus the protruding portion 33 can be inserted into the opening portion 44 easily and reliably.

Further, the protruding portion 33 is arranged above the first engaging portion 30 and has the lower surface 33*a* that extends backward gradually inclining downward.

According to that configuration, the sub frame 16 provided with the opening member 43 can be guided so as to be shifted downward by the inclination of the lower surface 33*a* of the protruding portion 33 as the opening member 43 extends backward, in the process of inserting the protruding portion 33 into the opening portion 44. As the result, the second engaging portion 41 is surely guided to the engagement with the first engaging portion 30.

Also, the sub frame 16 has the inner sub frame 16A, and the outer sub frame 16B arranged opposed to the inner sub frame 16A. The opening member 43 is a coupling plate coupling the inner sub frame 16A to the outer sub frame 16B.

According to that configuration, the strength of the sub frame 16 can be improved by the coupling plate (the opening member) 43. In addition, the opening portion 44 can be formed by using the coupling plate 43 that couples the inner sub frame 16A to the outer sub frame 16B, and the movement of the protruding portion 33 can be guided by the opening portion 44.

In addition, the front loader 7 includes the guide pin 42 provided on an edge portion of the opening portion 44 and configured to contact to the guide portion 33 and thereby to relatively move with respect to the main frame 15 in a process for attaching the sub frame 16 to the main frame 15.

According to that configuration, the guide pin 42 provided at the edge portion of the opening portion 44 moves in contact with the guide portion 33, and thereby the guide portion 33 can be surely guided to the opening portion 44.

Also, the guide pin 42 is fixed along the lower edge 44*a* of the opening portion 44 of the coupling plate 43.

According to that configuration, when the guide pin 42 is guided and moved by the guide portion 33, the guide portion 33 can be guided by the lower edge 44*a* and surely guided to the opening portion 44.

Also, the guide pin 42 is fixed along the upper edge 44*b* of the opening portion 44 of the coupling plate 43.

According to that configuration, when the guide pin 42 is guided and moved by the guide portion 33, the guide portion 33 can be guided by the upper edge 44*b* and surely guided to the opening portion 44.

Further, the opening portion 44 includes an upper portion, and a lower portion having a width wider than a width of the upper portion.

According to that configuration, the guide portion 33 can easily and reliably enter the opening portion 44 from the wide lower portion side, and the upper portion with the narrow width appropriately positions the guide portion 33 in the machine width direction.

In addition, the second engaging portion 41 is fixed to the coupling plate 43.

According to that configuration, the second engaging portion 41 and the coupling plate 43 can be integrated, and thereby the rigidity of the second engaging portion 41 and the coupling plate 43 can be improved.

In addition, the main frame 15 has a concave portion 34 configured to hold the guide pin 42 when the second engaging portion 41 is engaged with the first engaging portion 30.

According to that configuration, the guide pin 42 can be retracted to a position (the concave portion 34) that does not interfere with the engagement between the second engaging portion 41 and the first engaging portion 30. The second engaging portion 41 and the first engaging portion 30 can be surely engaged with each other by holding the guide pin 42 in the concave portion 34.

In addition, the front loader 7 includes the guide pin 42 provided on an edge portion of the opening portion 44 and configured to contact to the guide portion 33 and thereby to relatively move with respect to the main frame 15 in a process for attaching the sub frame 16 to the main frame 15. The main frame 15 has the concave portion 34 configured to hold the guide pin 42 when the second engaging portion 41 is engaged with the first engaging portion 30, the concave portion 34 being provided on an extended line of the lower surface 33*a* of the protruding portion (the guide portion) 33.

According to that configuration, the guide pin 42 moves along the lower surface 33*a* of the protruding portion (guide portion) 33, and the guide pin 42 can be surely guided to the recessed portion 34.

A working machine 1 includes the front loader described above, and the vehicle body 2 supporting the front loader 7.

According to that configuration, it is possible to provide the working machine 1 configured to easily attach the front loader 7 to the vehicle body 2 even when the vehicle body 2 is inclined with respect to the front loader 7.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A front loader comprising:

a boom;

a main frame attached to a vehicle body;

a sub frame supporting the boom and being detachably attached to the main frame;

a receiving tool provided on the main frame;

a cylindrical shaft provided on the sub frame and configured to be engaged with the receiving tool when attaching the sub frame to the main frame;

a protruding portion protruding from the main frame and configured to guide the cylindrical shaft to be engaged with the receiving tool; and a coupling plate provided on the sub frame, the coupling plate having an opening through which the protruding portion is inserted when the cylindrical shaft is engaged with the receiving tool, wherein the protruding portion protrudes forward from the main frame in a front-rear direction of the vehicle body.

2. The front loader according to claim 1, wherein the protruding portion has upper and lower surfaces both of which are inclined forward from the main frame in a front-rear direction of the vehicle body.

3. The front loader according to claim 1, wherein the receiving tool is rigidly fixed to the main frame.

4. The front loader according to claim 1, wherein a portion of the coupling plate which has the opening extends in a substantially vertical direction.

5. The front loader according to claim 1, wherein an edge portion of the opening contacts to the protruding portion and thereby guides the protruding portion to be moved in an insertion direction of the protruding portion in a process for attaching the sub frame to the main frame.

6. The front loader according to claim 1, wherein the protruding portion is arranged above the receiving tool, and has upper and lower surfaces both of which are inclined forward from the main frame in a front-rear direction of the vehicle body.

7. The front loader according to claim 1, wherein the sub frame includes an inner sub frame and an outer sub frame arranged opposed to the inner sub frame, and wherein the coupling plate couples the inner sub frame with the outer sub frame.

8. The front loader according to claim 1, further comprising a guide pin provided on an edge portion of the opening, and configured to be in contact with a lower surface of the protruding portion and to move closer to the main frame in a process for attaching the sub frame to the main frame.

9. The front loader according to claim 8, wherein the guide pin is fixed along a lower edge of the opening.

10. The front loader according to claim 8, wherein the main frame has a concave portion configured to hold the guide pin when the cylindrical shaft is engaged with the receiving tool.

11. The front loader according to claim 10, wherein the concave portion is provided on an extended line of a lower surface of the protruding portion.

12. The front loader according to claim 1, wherein the opening includes an upper portion and a lower portion having a width wider than a width of the upper portion.

13. The front loader according to claim 1, wherein the cylindrical shaft is fixed to the coupling plate.

14. A working machine comprising:

the front loader according to claim 1; and the vehicle body supporting the front loader.

* * * * *